US011519239B2

(12) United States Patent
Greci et al.

(10) Patent No.: US 11,519,239 B2
(45) Date of Patent: Dec. 6, 2022

(54) RUNNING LINES THROUGH EXPANDABLE METAL SEALING ELEMENTS

(71) Applicant: Halliburton Energy Services, Inc., Houston, TX (US)

(72) Inventors: Stephen Michael Greci, Little Elm, TX (US); Michael Linley Fripp, Carrollton, TX (US); Gregory Scott Cunningham, Spring, TX (US); Darrell Wayne Adkins, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/667,678

(22) Filed: Oct. 29, 2019

(65) Prior Publication Data

US 2021/0123319 A1 Apr. 29, 2021

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/1277
See application file for complete search history.

(56) References Cited

U.S. PATENT DOCUMENTS

| | | | |
|---|---|---|---|
| 1,982,569 | A | 11/1934 | Byrd |
| 3,046,601 | A | 7/1962 | Hubbert et al. |
| 3,385,367 | A | 5/1968 | Kollsman |
| 4,445,694 | A | 5/1984 | Flaherty |
| 4,612,985 | A | 9/1986 | Rubbo et al. |
| 4,846,278 | A | 7/1989 | Robbins |
| 5,139,235 | A | 8/1992 | Kilmer |
| 5,163,321 | A | 11/1992 | Perales |
| 5,803,177 | A | 9/1998 | Hriscu et al. |
| 6,098,717 | A | 8/2000 | Bailey et al. |
| 6,321,861 | B1 | 11/2001 | Leichter |

(Continued)

FOREIGN PATENT DOCUMENTS

| | | | |
|---|---|---|---|
| CA | 2751473 | A1 | 8/2010 |
| CA | 2751473 | C | 9/2014 |

(Continued)

OTHER PUBLICATIONS

International Search Report and Written Opinion dated Nov. 19, 2018; International PCT Application No. PCT/US2018/019337.

(Continued)

*Primary Examiner* — Cathleen R Hutchins
*Assistant Examiner* — Ronald R Runyan
(74) *Attorney, Agent, or Firm* — McGuireWoods LLP

(57) ABSTRACT

Methods for traversing an expandable metal sealing element. An example method includes positioning an expandable metal sealing element in a wellbore; wherein the expandable metal sealing element includes a reactive metal and a void extending axially through at least a portion of the expandable metal sealing element. The method further includes disposing a line in the void and contacting the expandable metal sealing element with a fluid that reacts with the reactive metal to produce a reaction product having a volume greater than the reactive metal, wherein the reaction product seals around the line while it is disposed in the void.

20 Claims, 14 Drawing Sheets

(56) References Cited

U.S. PATENT DOCUMENTS 6,367,845 B1 4/2002 Otten et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 7/2011 Renshaw et al.
8,083,000 B2 * 12/2011 Nutley ..... E21B 17/003 166/387
8,235,075 B2 8/2012 Saltel
8,240,377 B2 8/2012 Kulakofsky et al.
8,434,571 B2 * 5/2013 Kannan ..... E21B 17/1035 175/325.4
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 3/2017 Xu et al.
9,624,752 B2 4/2017 Resink
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Vasques
10,704,362 B2 7/2020 Themig et al.
10,851,615 B2 12/2020 Watson et al.
10,961,804 B1 3/2021 Fripp et al.
2002/0125008 A1 9/2002 Wetzel et al.
2003/0150614 A1 8/2003 Brown et al.
2004/0118572 A1 6/2004 Whanger et al.
2004/0149418 A1 8/2004 Bosma et al.
2004/0244994 A1 12/2004 Jackson
2005/0039927 A1 2/2005 Wetzel et al.
2005/0092485 A1 5/2005 Brezinski
2005/0171248 A1 8/2005 Li et al.
2005/0199401 A1 9/2005 Patel et al.
2005/0257961 A1 11/2005 Snell et al.
2006/0175065 A1 8/2006 Ross
2007/0089911 A1 4/2007 Moyes
2007/0125532 A1 6/2007 Murray et al.
2007/0200299 A1 8/2007 Kunz
2007/0257405 A1 11/2007 Freyer
2008/0066931 A1 3/2008 Ku
2008/0142214 A1 6/2008 Keller
2008/0149351 A1 6/2008 Marya et al.
2008/0185150 A1 8/2008 Brown
2008/0185158 A1 8/2008 Chalker et al.
2008/0220991 A1 9/2008 Slay et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0163252 A1 7/2010 Regnault De La Mothe et al.
2010/0212891 A1 8/2010 Stewart et al.
2010/0270031 A1 10/2010 Patel
2010/0307770 A1 12/2010 Sponchia et al.
2011/0073310 A1 3/2011 Clemens
2011/0098202 A1 4/2011 James et al.
2011/0174504 A1 7/2011 Wright et al.
2011/0226374 A1 9/2011 Kalman
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0132427 A1 5/2012 Renshaw et al.
2012/0175134 A1 7/2012 Robisson et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2013/0056196 A1 3/2013 Hench
2013/0056227 A1 3/2013 Sponchia
2013/0056228 A1 3/2013 Gruetzmann et al.
2013/0146312 A1 6/2013 Gerrard et al.
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0238692 A1 8/2014 Watson
2014/0251641 A1 9/2014 Marya et al.
2014/0262351 A1 9/2014 Derby
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Droger et al.
2015/0369027 A1 12/2015 Jones et al.
2016/0032696 A1 2/2016 Caccialupi et al.
2016/0137912 A1 5/2016 Sherman et al.
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 8/2016 Mazyar et al.
2016/0319633 A1 11/2016 Cooper et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2017/0335673 A1 11/2017 Burke et al.
2018/0078998 A1 3/2018 Sherman
2018/0085154 A1 3/2018 Kulper et al.
2018/0087346 A1 3/2018 Rochen
2018/0087350 A1 3/2018 Sherman
2018/0266215 A1 9/2018 Fagley, IV et al.
2018/0355691 A1 12/2018 Andersen
2018/0355693 A1 12/2018 Al-Abduljabbar et al.
2019/0017285 A1 1/2019 Kain
2019/0055808 A1 2/2019 Krueger
2019/0128074 A1 5/2019 Stokes et al.
2019/0153852 A1 5/2019 Lallemand et al.
2019/0203101 A1 7/2019 Dusterhoft et al.
2019/0249509 A1 8/2019 Jakkula et al.
2019/0360297 A1 11/2019 Heiman et al.
2020/0240235 A1 7/2020 Fripp et al.
2020/0325749 A1 10/2020 Fripp et al.
2020/0370391 A1 11/2020 Fripp et al.
2021/0017441 A1 1/2021 Fripp et al.
2021/0079756 A1 3/2021 Omelaz et al.
2021/0140255 A1 5/2021 Greci et al.
2021/0189817 A1 6/2021 Fripp et al.

(56) References Cited

U.S. PATENT DOCUMENTS

| | | | |
|---|---|---|---|
| 2021/0332659 | A1 | 10/2021 | Fripp et al. |
| 2021/0353037 | A1 | 11/2021 | Cote |
| 2022/0074221 | A1 | 3/2022 | Laimbeer et al. |

FOREIGN PATENT DOCUMENTS

| | | | |
|---|---|---|---|
| CA | 3085547 | A1 | 8/2019 |
| CN | 1708631 | A | 12/2005 |
| CN | 102027189 | A | 4/2011 |
| CN | 104583530 | A | 4/2015 |
| CN | 105422146 | A | 3/2016 |
| CN | 106522923 | A | 3/2017 |
| CN | 107148444 | A | 9/2017 |
| CN | 107250321 | A | 10/2017 |
| CN | 107532466 | A | 1/2018 |
| EP | 2399000 | A2 | 12/2011 |
| EP | 2217790 | B1 | 10/2016 |
| EP | 2753791 | B1 | 6/2017 |
| FR | 3073549 | A1 | 5/2019 |
| GB | 2381278 | A | 4/2003 |
| GB | 2416796 | A | 2/2006 |
| GB | 2469723 | A | 10/2010 |
| GB | 2514195 | B | 6/2019 |
| GB | 2583232 | A | 10/2020 |
| GB | 2557397 | B | 8/2021 |
| MX | 2011008597 | A | 9/2011 |
| RU | 2424419 | C1 | 7/2011 |
| RU | 2588501 | C2 | 6/2016 |
| RU | 182236 | U1 | 8/2018 |
| WO | 0026501 | A1 | 5/2000 |
| WO | 2008079486 | A1 | 7/2008 |
| WO | 2010096417 | A2 | 8/2010 |
| WO | 2012090056 | A2 | 7/2012 |
| WO | 2013033208 | A1 | 3/2013 |
| WO | 2014098885 | A1 | 6/2014 |
| WO | 2014110382 | A1 | 7/2014 |
| WO | 2014210283 | A1 | 12/2014 |
| WO | 2016171666 | | 10/2016 |
| WO | 2018005740 | A1 | 1/2018 |
| WO | 2018057361 | A1 | 3/2018 |
| WO | 2018085102 | A1 | 5/2018 |
| WO | 2018147833 | A1 | 8/2018 |
| WO | 2019094044 | A1 | 5/2019 |
| WO | 2019147285 | A1 | 8/2019 |
| WO | 2019164492 | A1 | 8/2019 |
| WO | 2019164499 | A1 | 8/2019 |
| WO | 2020005252 | A1 | 1/2020 |
| WO | 2020018110 | A1 | 1/2020 |
| WO | 2021021203 | A1 | 2/2021 |
| WO | 2021076141 | A1 | 4/2021 |

OTHER PUBLICATIONS

Denmark Examination Report and Search Report dated Mar. 16, 2021, Denmark Application No. PA202070389.
International Search Report and Written Opinion dated Jul. 8, 2020, issued in related International Application No. PCT/US2019/056814.
International Search Report and Written Opinion dated Aug. 2, 2018, International PCT Application No. PCT/US2017/061307.
Search Report in FR Application No. 1859379, dated Oct. 15, 2019.
International Search Report and Written Opinion for corresponding PCT International Application No. PCT/US2019/068497; dated Sep. 17, 2020.
International Search report and Written Opinion for corresponding International Patent Application No. PCT/US2019/062225, dated Aug. 11, 2020.
International Search report and Written Opinion issued in related PCT/US2019/068493 dated Sep. 15, 2020.
NEMISIS Annulus Swellable Packer, Weatherford, Swellable Products, 2009-2011.
International Search Report and Written Opinion date dated Nov. 22, 2019; International PCT Application No. PCT/US2019/019210.
International Search Report and Witten Opinion dated May 20, 2020, issued in related PCT/US2019/047529.
Tao, Solid expandable tubular patching technique for high-temperature and high-pressure casing damaged wells, Research Paper, Jun. 2015, pp. 408-413, Petroleum Exploration and Development, vol. 42, issue 3.
Dutch Search Report issued in NL 2026726, dated Aug. 13, 2021.
International Search Report and Written Opinion dated Sep. 8, 2021 in PCT/US2020/066193.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion In PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report date dated Dec. 17, 2021; CN Application No. 2018800875885.
Examination Report in GB Appln No. 2010931.0 dated, Jan. 18, 2022.
International Search Report & Written Opinion in PCT/US2020/065539, dated Aug. 30, 2021.
International Search Report & Written Opinion in PCT/US2019/058904, dated Jul. 23, 2020.
French Search Report issued in FR Appln No. FR2006166, dated May 30, 2022.
International Search Report & Written Opinion in PCT/US2021/048628 dated May 19, 2022.
MY Search Report in MY Application No. PI2020003430, dated May 26, 2022.
GB Examination Report in Application No. 2010931.0 dated Apr. 5, 2022.
International Preliminary Report on Patentability in PCT/US2019/068493, dated Jun. 30, 2022.
International Preliminary Report on Patentability in PCT/US2019/068497, dated Jun. 30, 2022.

* cited by examiner

RUNNING LINES THROUGH EXPANDABLE METAL SEALING ELEMENTS

TECHNICAL FIELD

The present disclosure relates to running lines through expandable metal sealing elements, and more particularly, to the traversal of various configurations of expandable metal sealing elements that are configured to hold and seal around various types of lines, such as control lines and electrical lines.

BACKGROUND

Sealing elements may be used for a variety of wellbore applications, including forming annular seals in and around conduits in wellbore environments. Typically, sealing elements comprise swellable materials that may swell if contacted with specific swell-inducing fluids. An example of these swellable sealing elements are swell packers that may form annular seals in both open and cased wellbores. The annular seal may restrict all or a portion of fluid and/or pressure communication at the seal interface. Seal formation is an important part of wellbore operations at all stages of drilling, completion, and production.

Many species of the aforementioned swellable materials comprise elastomers. Elastomers, such as rubber, swell when contacted with a swell-inducing fluid. The swell-inducing fluid may diffuse into the elastomer where a portion may be retained within the internal structure of the elastomer. Swellable materials such as elastomers may be limited to use in specific wellbore environments, for example, those without high salinity and/or high temperatures. Further, running lines downhole may require traversing sealing elements. In order to traverse a sealing element, the line may need to be spliced and/or connected to a connection point that traverses the sealing element. The present disclosure provides improved apparatus and methods for running lines through sealing elements and for forming seals in wellbore applications.

BRIEF DESCRIPTION OF THE DRAWINGS

Illustrative examples of the present disclosure are described in detail below with reference to the attached drawing figures, which are incorporated by reference herein, and wherein.

Figure 1:
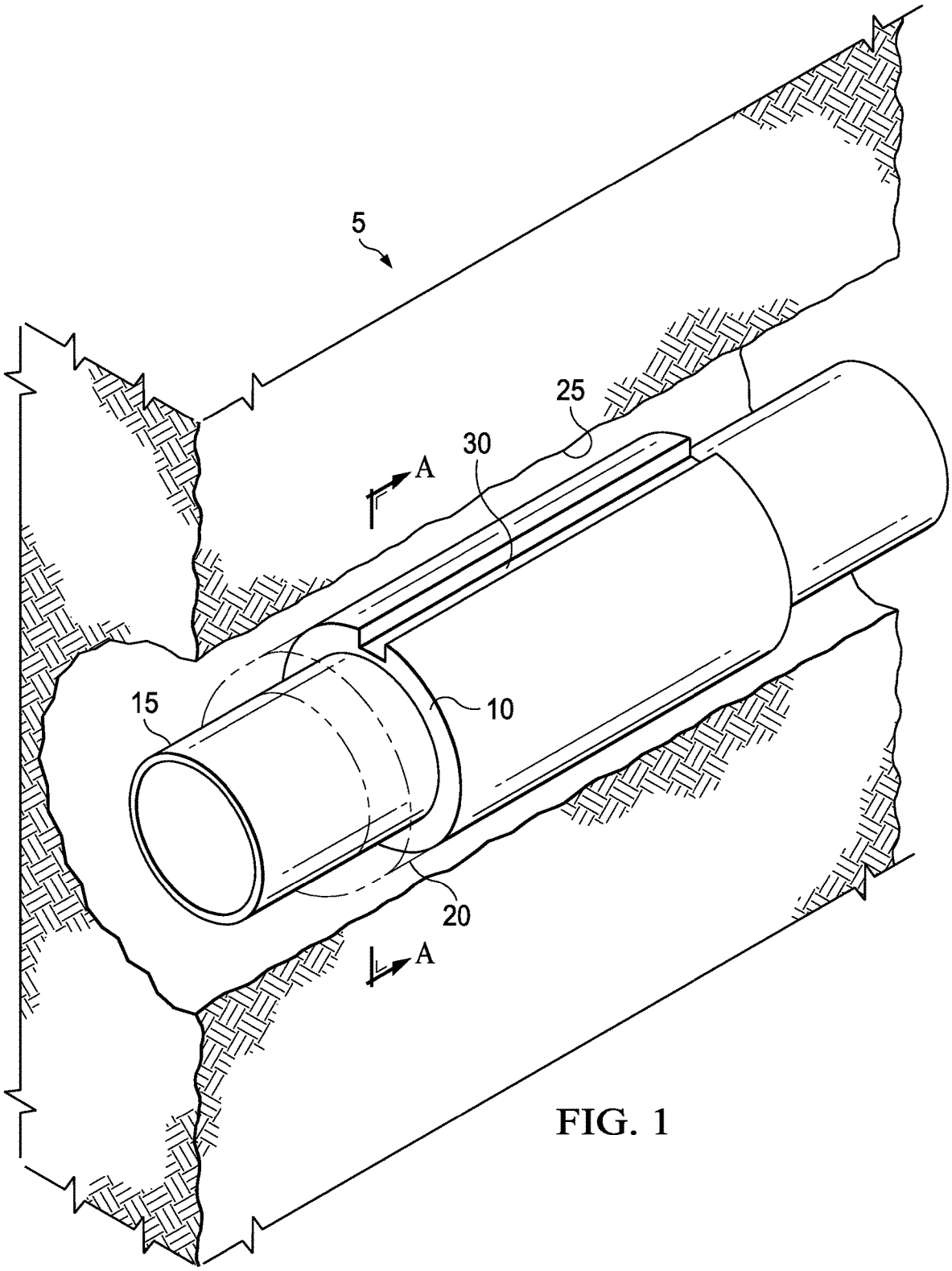
FIG. 1 is a perspective view of an example wellbore sealing system in accordance with the examples disclosed herein.

The illustrated figures are only exemplary and are not intended to assert or imply any limitation with regard to the environment, architecture, design, or process in which different examples may be implemented.

DETAILED DESCRIPTION

The present disclosure relates to running lines through expandable metal sealing elements, and more particularly, to the traversal of various configurations of expandable metal sealing elements that are configured to hold and seal around various types of lines, such as control lines and electrical lines.

In the following detailed description of several illustrative examples, reference is made to the accompanying drawings that form a part hereof, and in which is shown by way of illustration examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems described herein relate to the use of sealing elements comprising reactive metals. As used herein, "sealing elements" refers to any element used to form a seal or to create an anchor. The seal provides a substantial restriction to the flow of fluids across the sealing element. In some examples, the sealing elements described herein may form a seal that complies with the International Organization for Standardization (ISO) 14310: 2001/API Specification 11D1 1$^{st}$ Edition validation standard for the Grade V5: Liquid Test. An anchor provides a substantial restriction to movement of a tubing string. The metal sealing elements expand by chemically reacting with a specific reaction-inducing fluid to produce a reaction product having a larger volume than the base reactive metal reactant. By "expand," "expanding," or "expandable" it is meant that the expandable metal sealing element increases its volume as the reactive metal reacts with the reaction-inducing fluid, such as a brine. This reaction induces the formation of the reaction products resulting in the volumetric expansion of the metal sealing element as these reaction products are formed. The reaction products of the expandable metal and the reaction-inducing fluid occupy more volumetric space than the unreacted reactive metal, and thus the metal sealing element expands outward as the reaction of the reactive metal with the reaction-inducing fluid proceeds. Advantageously, the reactive metal sealing elements may be used in a variety of wellbore applications where an irreversible seal is desired. Yet a further advantage is that the expandable metal sealing elements may swell in high-salinity and/or high-temperature environments that may be unsuitable for some other species of sealing elements. An additional advantage is that the expandable metal sealing elements comprise a wide variety of metals and metal alloys and may expand upon contact with reaction-inducing fluids, including a variety of wellbore fluids. Another advantage is that the expandable metal sealing elements may be used as replacements for other types of sealing elements (e.g., elastomeric sealing elements), or they may be used as backups for other types of sealing elements. One other advantage is that a line may be disposed in a void extending axially through the expandable metal sealing element. A "line" and any variation thereof, as used herein, refers generally to a conveyance line used to convey power, light, data, instructions, pressure, fluids, etc. Examples of lines may include, but are not limited to, control lines, power lines, hydraulic lines, data lines, fiber optic lines, chemical injection lines, et cetera. Advantageously, the expandable metal sealing elements may be configured to allow the line to traverse the expandable metal sealing element unspliced or the need to couple to a connection point. A still further advantage is that the expandable metal sealing elements may seal around the line automatically when expanded without the need for action by an operator.

The expandable metal sealing element comprises a reactive metal that undergoes a chemical reaction in the presence of a reaction-inducing fluid (e.g., a brine) to form a reaction product (e.g., metal hydroxides). The resulting reaction products occupy more volumetric space relative to the base reactive metal reactant. This difference in volume allows the metal sealing element to be expandable so that it may form a seal at the interface of the expanded metal sealing element and any adjacent surface. Magnesium may be used to illustrate the volumetric expansion of the reactive metal as it undergoes reaction with the reaction-inducing fluid. A mole of magnesium has a molar mass of 24 g/mol and a density of 1.74 g/cm$^3$, resulting in a volume of 13.8 cm$^3$/mol. Magnesium hydroxide, the reaction product of magnesium and an aqueous reaction-inducing fluid, has a molar mass of 60 g/mol and a density of 2.34 g/cm$^3$, resulting in a volume of 25.6 cm$^3$/mol. The magnesium hydroxide volume of 25.6 cm$^3$/mol is an 85% increase in volume over the 13.8 cm$^3$/mol volume of the mole of magnesium. As another example, a mole of calcium has a molar mass of 40 g/mol and a density of 1.54 g/cm$^3$, resulting in a volume of 26.0 cm$^3$/mol. Calcium hydroxide, the reaction product of calcium and an aqueous reaction-inducing fluid, has a molar mass of 76 g/mol and a density of 2.21 g/cm$^3$, resulting in a volume of 34.4 cm$^3$/mol. The calcium hydroxide volume of 34.4 cm$^3$/mol is a 32% increase in volume over the 26.0 cm$^3$/mol volume of the mole of calcium. As yet another example, a mole of aluminum has a molar mass of 27 g/mol and a density of 2.7 g/cm$^3$, resulting in a volume of 10.0 cm$^3$/mol. Aluminum hydroxide, the reaction product of aluminum and an aqueous reaction-inducing fluid, has a molar mass of 63 g/mol and a density of 2.42 g/cm$^3$, resulting in a volume of 26 cm$^3$/mol. The aluminum hydroxide volume of 26 cm$^3$/mol is a 160% increase in volume over the 10 cm$^3$/mol volume of the mole of aluminum. The reactive metal may comprise any metal or metal alloy that undergoes a chemical reaction to form a reaction product having a greater volume than the base reactive metal or alloy reactant.

Examples of suitable metals for the reactive metal include, but are not limited to, magnesium, calcium, aluminum, tin, zinc, beryllium, barium, manganese, or any combination thereof. Preferred metals include magnesium, calcium, and aluminum.

Examples of suitable metal alloys for the reactive metal include, but are not limited to, alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like.

In some examples, the metal is alloyed to increase or to decrease reactivity and/or to control the formation of oxides and hydroxides. In other examples, the metal is heat treated to control the size and shape of the oxides and hydroxides including precipitation hardening, quenching, and tempering.

In some examples, the metal alloy is also alloyed with a dopant metal that promotes corrosion or inhibits passivation and thus increases the rate of hydroxide formation. Examples of dopant metals include, but are not limited to, nickel, iron, copper, carbon, titanium, gallium, mercury, cobalt, iridium, gold, palladium, or any combination thereof. In another example, particles of the metal are coated with the dopant and the coated metal powder is pressed and extruded to create the metal alloy.

In some examples, the reactive metal comprises an oxide. As an example, calcium oxide reacts with water in an energetic reaction to produce calcium hydroxide. One mole of calcium oxide occupies 9.5 $cm^3$, whereas one mole of calcium hydroxide occupies 34.4 $cm^3$. This is a 260% volumetric expansion of the mole of calcium oxide relative to the mole of calcium hydroxide. Examples of metal oxides suitable for the reactive metal may include, but are not limited to, oxides of any metals disclosed herein, including magnesium, calcium, aluminum, iron, nickel, copper, chromium, tin, zinc, lead, beryllium, barium, gallium, indium, bismuth, titanium, manganese, cobalt, or any combination thereof.

It is to be understood that the selected reactive metal is chosen such that the formed expandable metal sealing element does not dissolve or otherwise degrade in the reaction-inducing fluid. As such, the use of metals or metal alloys for the reactive metal that form relatively insoluble reaction products in the reaction-inducing fluid may be preferred. As an example, the magnesium hydroxide and calcium hydroxide reaction products have very low solubility in water. As an alternative or an addition, the expandable metal sealing element may be positioned and configured in a way that constrains the degradation of the expandable metal sealing element in the reaction-inducing fluid due to the geometry of the area in which the expandable metal sealing element is disposed. This may result in reduced exposure of the expandable metal sealing element to the reaction-inducing fluid, but may also reduce degradation of the reaction product of the expandable metal sealing element, thereby prolonging the life of the formed seal. As an example, the volume of the area in which the expandable metal sealing element is disposed may be less than the potential expansion volume of the volume of reactive metal disposed in said area. In some examples, this volume of area may be less than as much as 50% of the expansion volume of reactive metal. Alternatively, this volume of area may be less than 90% of the expansion volume of reactive metal. As another alternative, this volume of area may be less than 80% of the expansion volume of reactive metal. As another alternative, this volume of area may be less than 70% of the expansion volume of reactive metal. As another alternative, this volume of area may be less than 60% of the expansion volume of reactive metal. In a specific example, a portion of the expandable metal sealing element may be disposed in a recess within the body of the conduit or downhole tool.

In some examples, the formed reaction products of the reactive metal reaction may be dehydrated under sufficient pressure. For example, if a metal hydroxide is under sufficient contact pressure and resists further movement induced by additional hydroxide formation, the elevated pressure may induce dehydration of the metal hydroxide to form the metal oxide. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water.

The expandable metal sealing elements may be formed in a solid solution process, a powder metallurgy process, or through any other method as would be apparent to one of ordinary skill in the art. Regardless of the method of manufacture, the expandable metal sealing elements may be slipped over the body of the conduit or downhole tool. Once in place, the expandable metal sealing element may be held in position with end rings, stamped rings, retaining rings, set screws, fasteners, adhesives, or any other such method for retaining the expandable metal sealing element in position. The expandable metal sealing elements may be formed and shaped to fit over existing conduits and downhole tools and thus may not require modification of the outer diameter or profile of the conduits and downhole tools. In alternative examples, the expandable metal sealing element may be cast onto the conduit or downhole tool. In some alternative examples, the diameter of the expandable metal sealing element may be reduced (e.g., by swaging) when disposed on the conduit or downhole tool.

In some optional examples, the expandable metal sealing element may include a removable barrier coating. The removable barrier coating may be used to cover the exterior surfaces of the sealing element and prevent contact of the reactive metal with the reaction-inducing fluid. The removable barrier coating may be removed when the sealing operation is to commence. The removable barrier coating may be used to delay sealing and/or prevent premature sealing with the expandable metal sealing element. Examples of the removable barrier coating include, but are not limited to, any species of plastic shell, elastomeric shell, organic shell, metallic shell, anodized shell, paint, dissolvable coatings (e.g., solid magnesium compounds), eutectic materials, or any combination thereof. When desired, the removable barrier coating may be removed from the sealing element with any sufficient method. For example, the removable barrier coating may be removed through dissolution, a phase change induced by changing temperature, corrosion, hydrolysis, the degradation of the support of the barrier coating, or the removable barrier coating may be time-delayed and degrade after a desired time under specific wellbore conditions.

In some optional examples, the expandable metal sealing element may include an additive that may be added to the expandable metal sealing element during manufacture as a part of the composition, or the additive may be coated onto the expandable metal sealing element after manufacturing. The additive may alter one or more properties of the reactive metal sealing element. For example, the additive may improve sealing, add texturing, improve bonding, improve gripping, etc. Examples of the additive include, but are not limited to, any species of ceramic, elastomer, glass, non-reacting metal, the like, or any combination.

The expandable metal sealing element may be used to form a seal between any adjacent surfaces that are proximate to the expandable metal sealing elements. Without limitation, the expandable metal sealing elements may be used to form seals on casing, formation surfaces, cement sheaths or layers, and the like. For example, an expandable metal sealing element may be used to form a seal between the outer diameter of a liner hanger and a surface of an adjacent casing. Alternatively, the expandable metal sealing element may be used to form a seal between the outer diameter of a conduit and a surface of an adjacent set cement layer. As another example, the expandable metal sealing element may be used to form a seal between the outer diameter of a tubing and a surface of the adjacent casing. Moreover, a plurality of the expandable metal sealing elements may be used to form multiple seals between adjacent surfaces.

As described above, the expandable metal sealing elements comprise reactive metals and as such, they are non-elastomeric materials. As non-elastomeric materials, the expandable metal sealing elements do not contain organic compounds, and, they will irreversibly expand when contacted with a reaction-inducing fluid. The expandable metal sealing elements will not return to their original size or shape even after the reaction-inducing fluid is removed from contact.

Generally, the reaction-inducing fluid induces a reaction in the reactive metal to form a reaction product that occupies more space than the unreacted reactive metal. Examples of the reaction-inducing fluid include, but are not limited to, saltwater (e.g., water containing one or more salts dissolved therein), brine (e.g., saturated saltwater, which may be produced from subterranean formations), seawater, freshwater, or any combination thereof. Generally, the reaction-inducing fluid may be from any source provided that the fluid does not contain an excess of compounds that may undesirably affect other components in the expandable metal sealing element. In the case of saltwater, brines, and seawater, the reaction-inducing fluid may comprise a monovalent salt or a divalent salt. Suitable monovalent salts may include, for example, sodium chloride salt, sodium bromide salt, potassium chloride salt, potassium bromide salt, and the like. Suitable divalent salt can include, for example, magnesium chloride salt, calcium chloride salt, calcium bromide salt, and the like. In some examples, the salinity of the reaction-inducing fluid may exceed 10%. In some examples, the density of the reaction-inducing fluid may exceed 8.5 pounds per gallon. Advantageously, the expandable metal sealing elements of the present disclosure may not be impacted by contact with high-salinity fluids. One of ordinary skill in the art, with the benefit of this disclosure, should be readily able to select a reaction-inducing fluid for inducing a reaction with the reactive metal.

The expandable metal sealing elements may be used in high-temperature formations, for example, in formations with zones having temperatures equal to or exceeding 350° F. Advantageously, the use of the expandable metal sealing elements of the present disclosure may not be impacted in high-temperature formations. In some examples, the expandable metal sealing elements may be used in both high-temperature formations and with high-salinity fluids. In a specific example, an expandable metal sealing element may be positioned and used to form a seal after contact with a brine having a salinity of 10% or greater while also being disposed in a wellbore zone having a temperature equal to or exceeding 350° F.

As discussed above, the line is, generally, a conveyance line that may convey power, data, instructions, pressure, fluids, etc. from the surface to a location within a wellbore. Examples of the line include, but are not limited to, a control line, power line, hydraulic line, fiber optic line, chemical injection line, an additional conduit for liquid and gas flow, or any combination of lines. The line may be used to power a downhole tool, control a downhole tool, provide instructions to a downhole tool, obtain wellbore environment measurements, inject a fluid, produce a fluid, etc. When the expandable metal sealing element is induced to expand through contact with a reaction-inducing fluid, the expandable metal sealing element may expand and close the void space around the line, thereby sealing it. The expandable metal sealing element seals around the line such that the line still functions and successfully spans the expandable metal sealing element even after expansion and sealing is performed.

FIG. 1 is a perspective view of an example wellbore sealing system, generally 5. Wellbore sealing system 5 comprises an expandable metal sealing element 10 disposed on a conduit 15. The expandable metal sealing element 10 may be held in place on the conduit 15 with end rings 20. The end rings 20 are optional and may be absent or substituted for other elements sufficient to maintain the expandable metal sealing element 10 in position when the conduit 15 is introduced downhole. As an alternative or an addition to the end rings 20, the expandable metal sealing element 10 may be held in place with stamped rings, retaining rings, set screws, fasteners, adhesives, or may be disposed in a recess precluding the need for any species of retaining element. Conduit 15 may be any species of wellbore conduit and may comprise production tubing, drillpipe, liner, liner hanger, etc. The expandable metal sealing element 10 may seal against an adjacent surface 25. The surface 25 is proximate to the expandable metal sealing element 10. The surface 25 may be the exterior surface of another conduit, a downhole tool, the wall of the subterranean formation, or a set cement layer. The expandable metal sealing element 10 further comprises a void 30. Void 30 extends axially along the length of the expandable metal sealing element 10. The void 30 is a recess machined into the exterior of the expandable metal sealing element 10. A line (not illustrated) may be disposed in the void 30 to traverse the expandable metal sealing element 10. When the expandable metal sealing element 10 is expanded, it may seal around the line and close the void 30. The void 30 may be produced in the expandable metal sealing element 10 in any sufficient manner as would be readily apparent to one of ordinary skill in the art. For example, the expandable metal sealing element 10 may be produced in an extrusion process. The die used in the extrusion process may be designed or modified to provide the illustrated shape of the void 30 as the expandable metal sealing element 10 is extruded.

Figure 2:
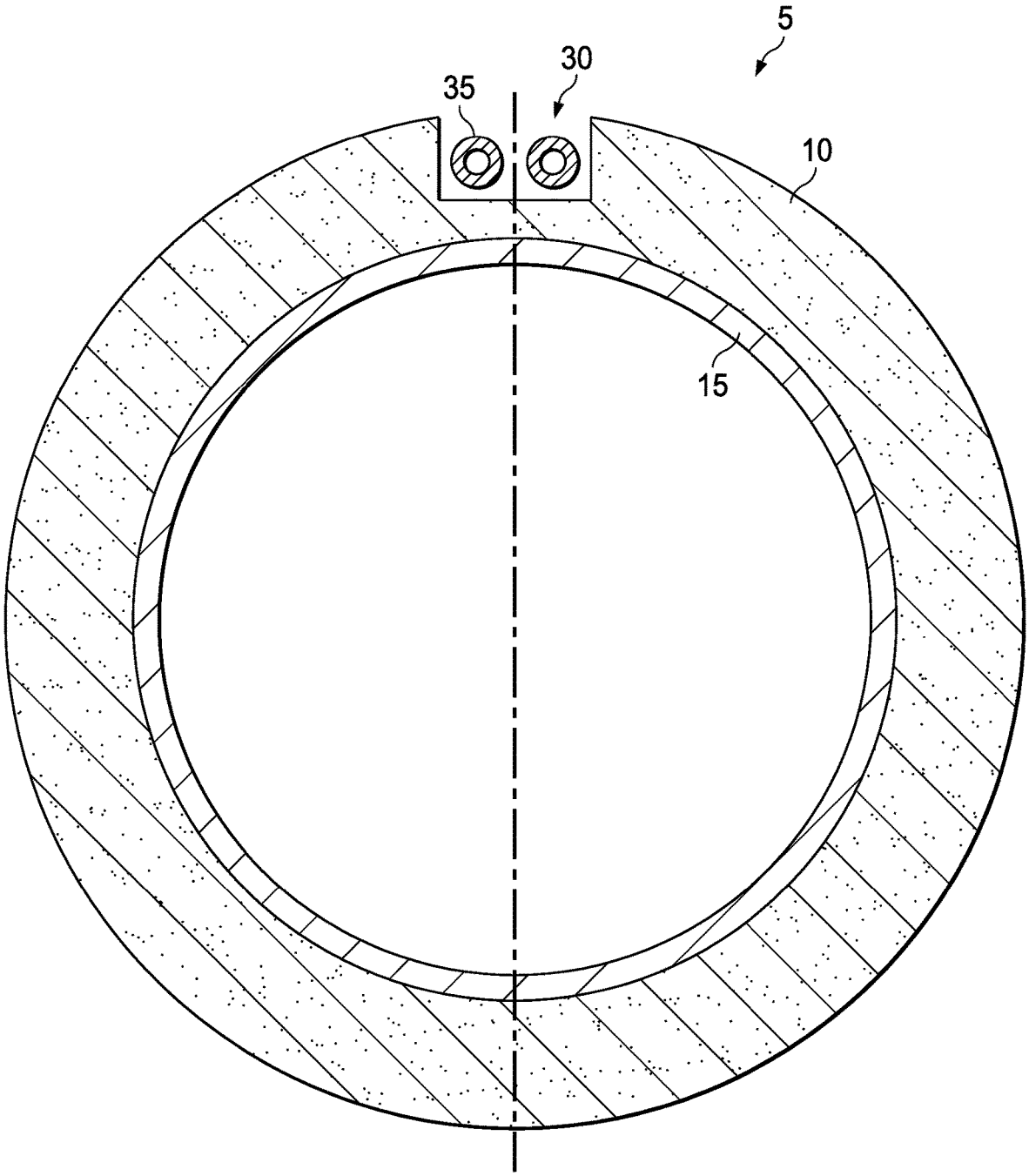
FIG. 2 is a cross-section view of the example wellbore sealing system of FIG. 1 taken along line A-A in accordance with the examples disclosed herein.

FIG. 2 is a cross-section view of the example wellbore sealing system 5 of FIG. 1 taken along line A-A. In the illustration of FIG. 2, two lines 35 have been disposed within the void 30 in the exterior of the expandable metal sealing element 10. The lines extend axially within void 30 along the length of the expandable metal sealing element 10. The lines 35 are unspliced and may be installed on the rig floor or at any other point in the wellbore operation. As the lines 35 are unspliced, it is not necessary to connect spliced ends downhole in order to traverse the expandable metal sealing element 10. It is also unnecessary to couple the lines to connection points downhole in order to traverse the expandable metal sealing element 10. The lines 35 may be coupled to a downhole tool or other such wellbore equipment when installed downhole. When the expandable metal sealing element 10 is exposed to a reaction-inducing fluid downhole, the reaction products are formed. The reaction products aggregate and solidify within the area around the conduit 15 to form a seal around the conduit 15. The reaction products also aggregated within the area previously defined as void 30 to form a seal around the lines 35 and to close the void 30. The lines 35 are not impaired or impacted by the reaction and resulting solidification of the reaction products. Although FIG. 2 illustrates the use of two lines 35, it is to be understood that any number of lines 35, including one line 35 or more than two lines 35, may be used with any of the examples disclosed herein.

Figure 3:
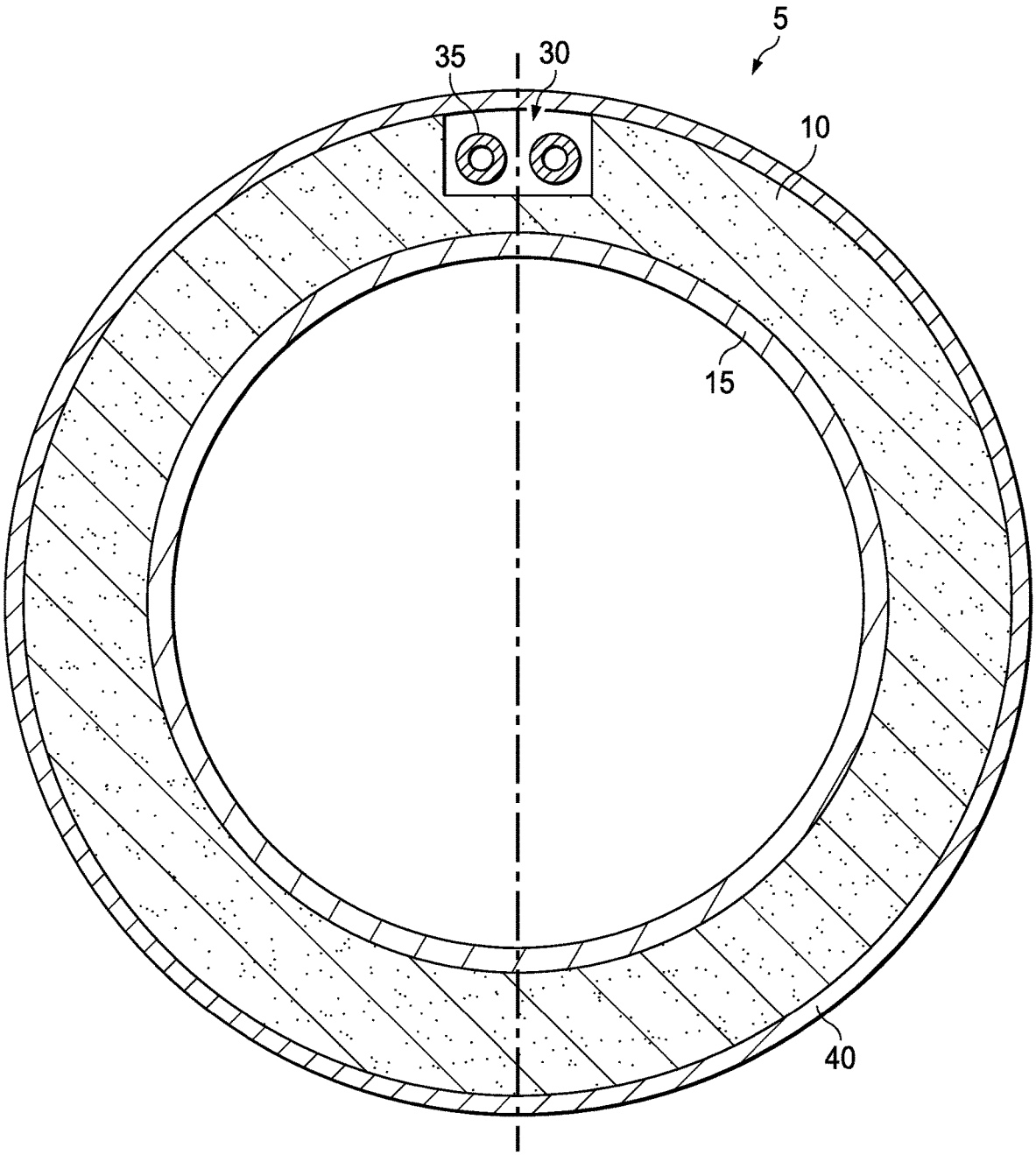
FIG. 3 is a cross-section view of the example wellbore sealing system of FIG. 2 further comprising a clamp in accordance with the examples disclosed herein.

FIG. 3 is a cross-section view of the example wellbore sealing system 5 of FIG. 2 further comprising a clamp 40. In the illustration of FIG. 3, the clamp 40 is placed on the exterior of the expandable metal sealing element 10. The clamp 40 is an optional component of the wellbore sealing system 5 and may not be present in all examples. The clamp 40 may be applied after disposing the lines 35 within void 30. The clamp 40 may be used to retain the lines 35 within the void 30 when the expandable metal sealing element 10 is introduced downhole. In some examples, the clamp 40 does not extend the entire length of the expandable metal sealing element 10. The clamp 40 may comprise any material sufficient for retaining lines 35 within the void 30. In some examples, the clamp 40 may comprise a reactive metal that is the same or different from the reactive metal selected for the expandable metal sealing element 10. In these examples, the clamp 40 may react with a reaction-inducing fluid to form reaction products and expand volumetrically in an analogous fashion to the expandable metal sealing element 10. In other examples, the clamp 40 is constructed from a non-reactive metal or from a polymer. Although FIG. 3 illustrates the use of two lines 35, it is to be understood that any number of lines 35, including one line 35 or more than two lines 35, may be used with any of the examples disclosed herein.

Figure 4:
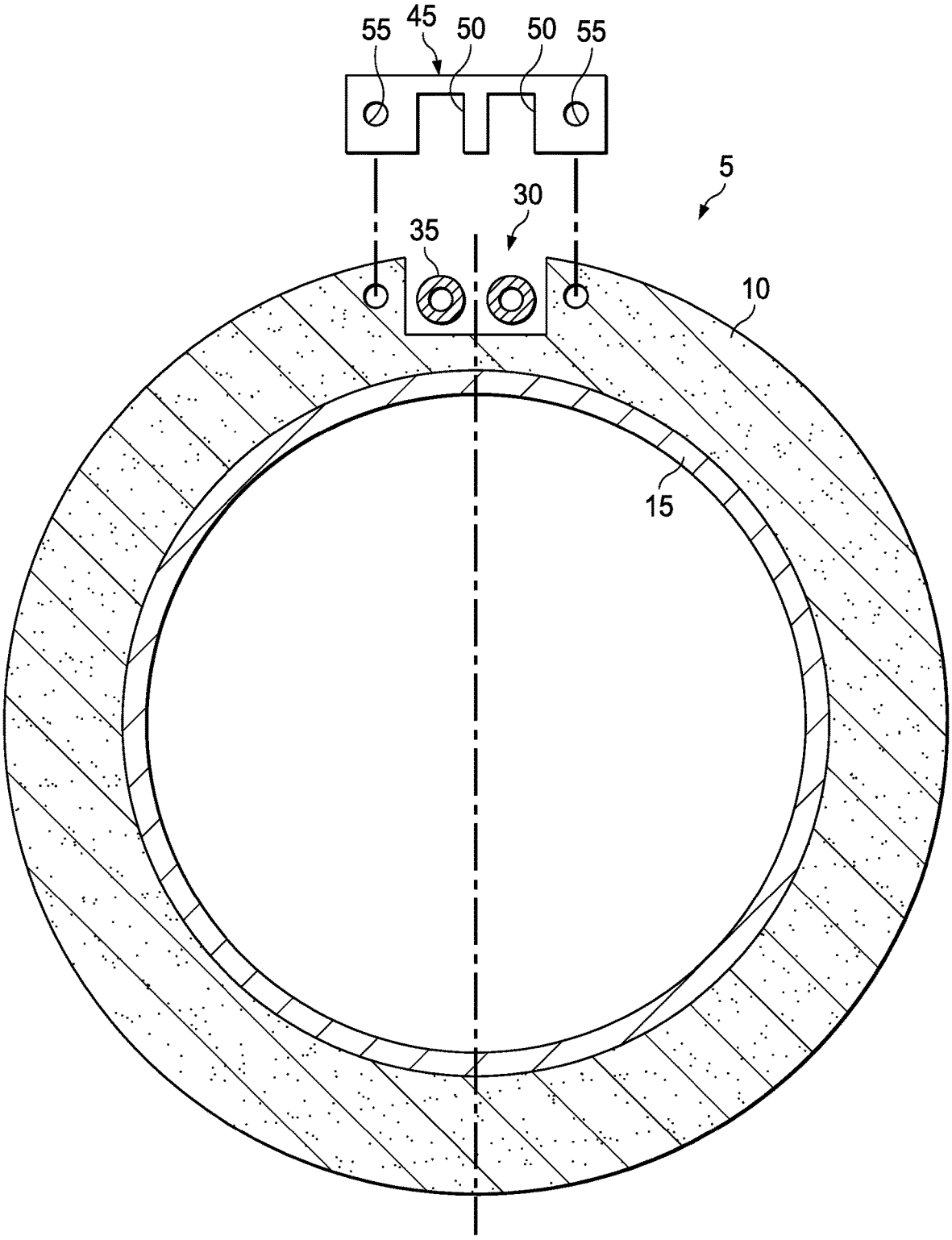
FIG. 4 is a cross-section view of the example wellbore sealing system of FIG. 2 further comprising an endplate in accordance with the examples disclosed herein.

FIG. 4 is a cross-section view of the example wellbore sealing system 5 of FIG. 2 further comprising an endplate 45. In the illustration of FIG. 4, the endplate 45 is placed proximate the terminal end of the expandable metal sealing element 10. In some examples, the wellbore sealing system 5 may comprise two endplates 45 placed on both of the terminal ends of the expandable metal sealing element 10. The endplate 45 is an optional component of the wellbore sealing system 5 and may not be present in all examples. The endplate 45 may be applied after disposing the lines 35 within void 30. The lines 35 may be run through openings 50 in the endplate 45. The endplate 45 may comprise one or more openings 50 for the lines 35. The endplate 45 may be used to retain the lines 35 within the void 30 when the expandable metal sealing element 10 is introduced downhole. The endplate 45 may be held in place with set screws through openings 55. The set screws may be screwed into the terminal end of the expandable metal sealing element 10. Alternative methods of attachment may also be used in some examples and the endplate 45 may be placed away from the ends of the expandable metal sealing element 10. The endplate 45 may comprise any material sufficient for retaining lines 35 within the void 30. In some examples, the endplate 45 may comprise a reactive metal that is the same or different from the reactive metal selected for the expandable metal sealing element 10. In these examples, the endplate 45 may react with a reaction-inducing fluid to form reaction products and expand volumetrically in an analogous fashion to the expandable metal sealing element 10. In some optional examples, the set screws that may couple the endplate 45 to the expandable metal sealing element 10 may also comprise a reactive metal and may also react with a reaction-inducing fluid to form reaction products and expand volumetrically in an analogous fashion to the expandable metal sealing element 10. Although FIG. 4 illustrates the use of two lines 35, it is to be understood that any number of lines 35, including one line 35 or more than two lines 35, may be used with any of the examples disclosed herein. In other examples, the endplate 45 is constructed from a non-reactive metal or from a polymer.

Figure 5:
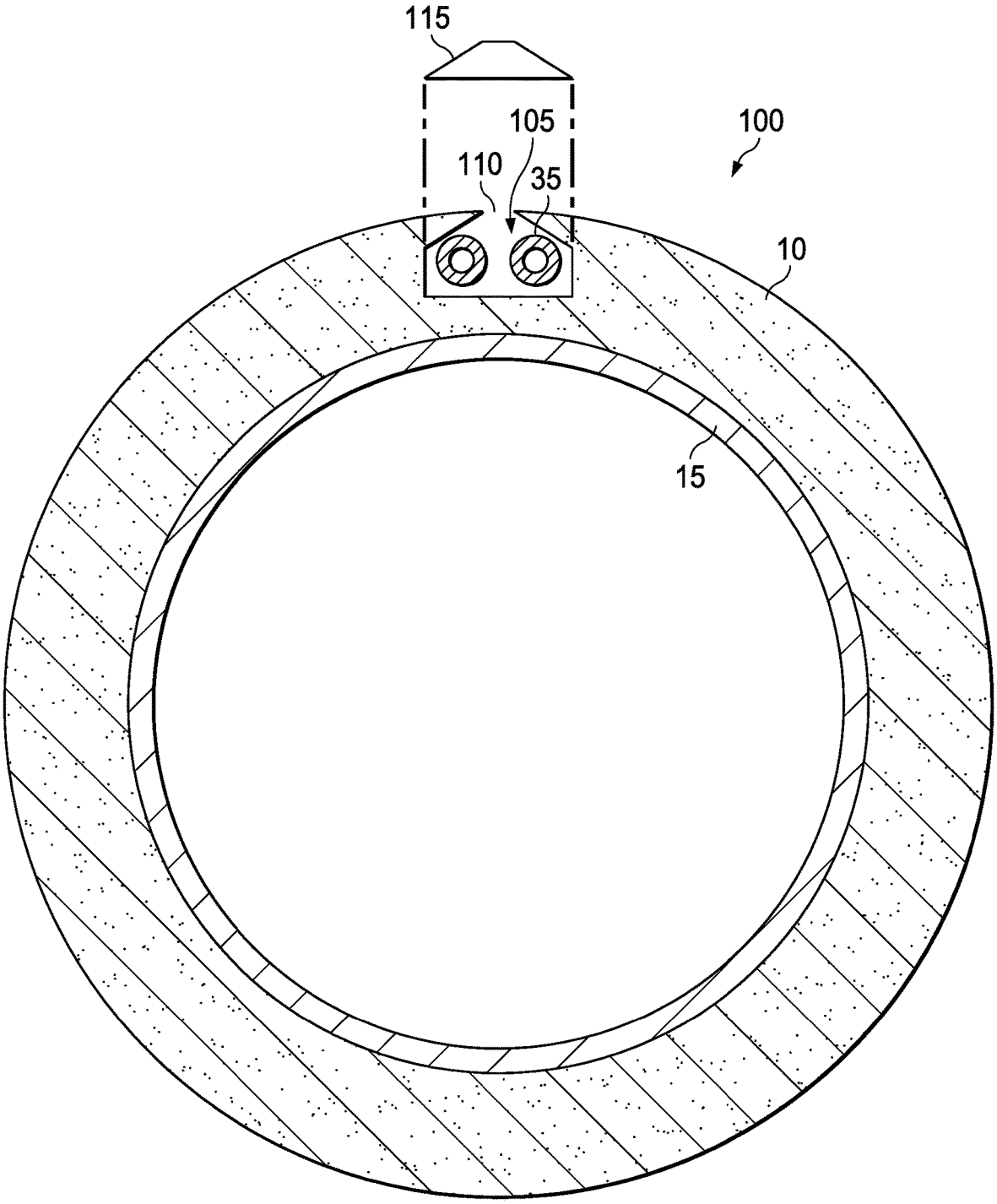
FIG. 5 is a cross-section view of an example wellbore sealing system comprising a wedge in accordance with the examples disclosed herein.

FIG. 5 is a cross-section view of another example of a wellbore sealing system, generally 100. The wellbore sealing system 100 is similar to the wellbore sealing system 5 illustrated in FIGS. 1 and 2. The wellbore sealing system 100 comprises an expandable metal sealing element 10, a conduit 15, and two lines 35 disposed within a void 105 in the exterior of the expandable metal sealing element 10. In the illustration of FIG. 5, the void 105 has been designed to have an opening 110 that is narrowed such that only one line is allowed through the opening 110 at a time. When the lines 35 have been disposed in the void 105, a wedge 115 may be forced into the void 105 to secure and retain the lines 35 therein. In some examples, the wedge 115 may also be bolted into place. The wedge 115 may comprise any material sufficient for retaining lines 35 within the void 105. In some examples, the wedge 115 may comprise a reactive metal that is the same or different from the reactive metal selected for the expandable metal sealing element 10. In these examples, the wedge 115 may react with a reaction-inducing fluid to form reaction products and expand volumetrically in an analogous fashion to the expandable metal sealing element 10. In some optional examples, the bolt that may optionally be used to hold the wedge 115 in place to the expandable metal sealing element 10, may also comprise a reactive metal and may also react with a reaction-inducing fluid to form reaction products and expand volumetrically in an analogous fashion to the expandable metal sealing element 10. In other examples, the wedge 115 and the bolt are constructed from a non-reactive metal or from a polymer. Although FIG. 5 illustrates the use of two lines 35, it is to be understood that any number of lines 35, including one line 35 or more than two lines 35, may be used with any of the examples disclosed herein. In some optional examples, the bolt that retains the wedge may be threadedly connected with screw threads. In other examples, the bolt may is frictionally connected such as with a press fit.

Figure 6:
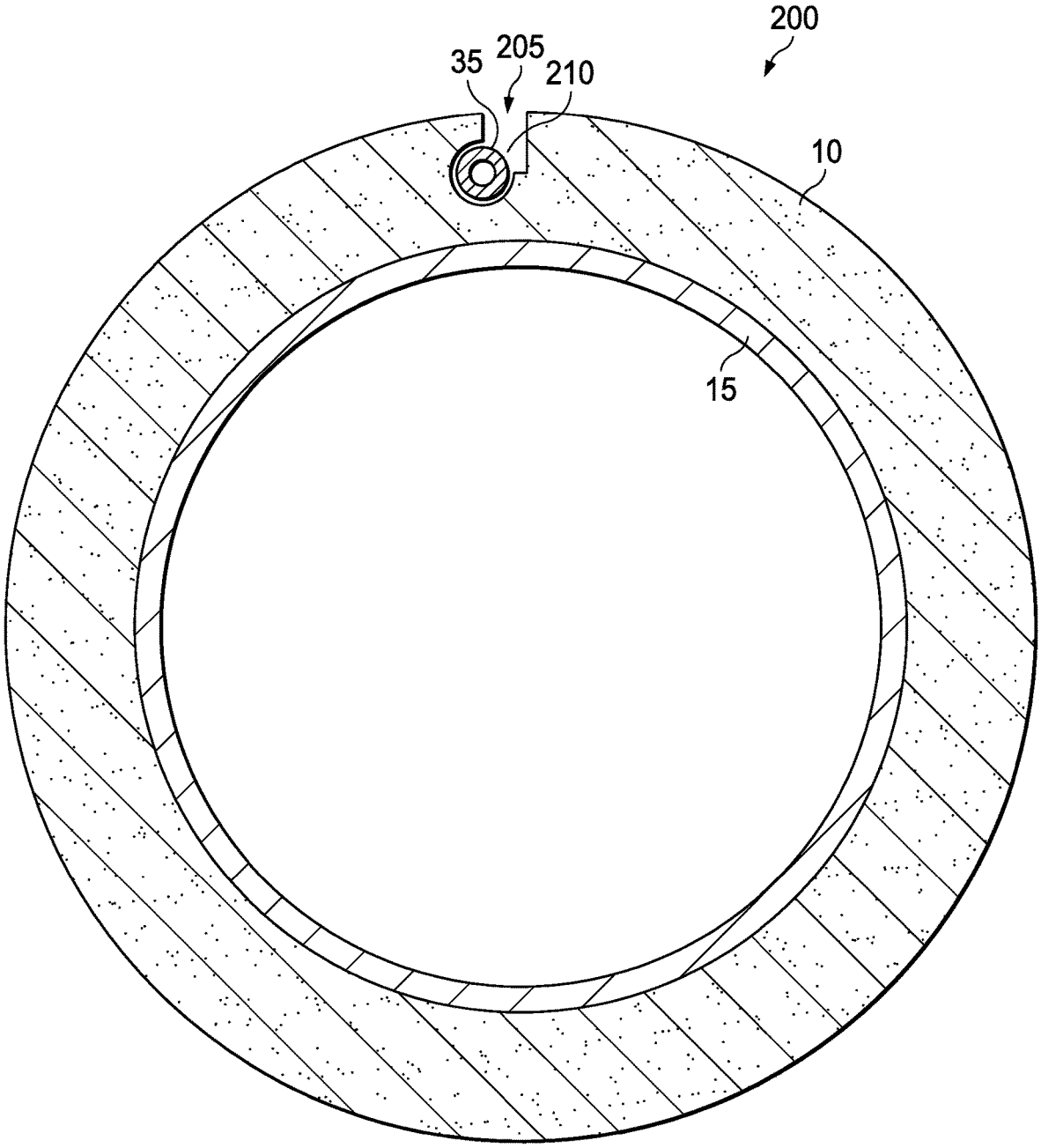
FIG. 6 is a cross-section view of an example wellbore sealing system comprising a narrowed opening in accordance with the examples disclosed herein.

FIG. 6 is a cross-section view of another example of a wellbore sealing system, generally 200. The wellbore sealing system 200 is similar to the wellbore sealing systems 5 and 100 illustrated in FIGS. 1-5. The wellbore sealing system 200 comprises an expandable metal sealing element 10, a conduit 15, and one line 35 disposed within a void 205 in the exterior of the expandable metal sealing element 10. In the illustration of FIG. 6, the void 205 has been designed to have an opening 210 that is narrowed such that the line 35 is allowed to snap through it with sufficient applied force. When the line 35 is disposed in the void 205, it is locked in due to the narrowness of the opening 210. The die used in the extrusion process to produce the expandable metal sealing element 10 may be designed or modified to provide the illustrated shape of the void 205 as the expandable metal sealing element 10 is extruded. The shape of the opening 210 may be tailored to be sufficiently narrow to allow the line 35 to snap in to the void 205 with a desired amount of force, but not be so wide as to allow the line 35 to free itself of the void 205 while the wellbore sealing system 200 is introduced downhole. Although FIG. 6 illustrates the use of one line 35, it is to be understood that any number of lines 35, including more than one line 35, may be used with any of the examples disclosed herein.

Figure 7:
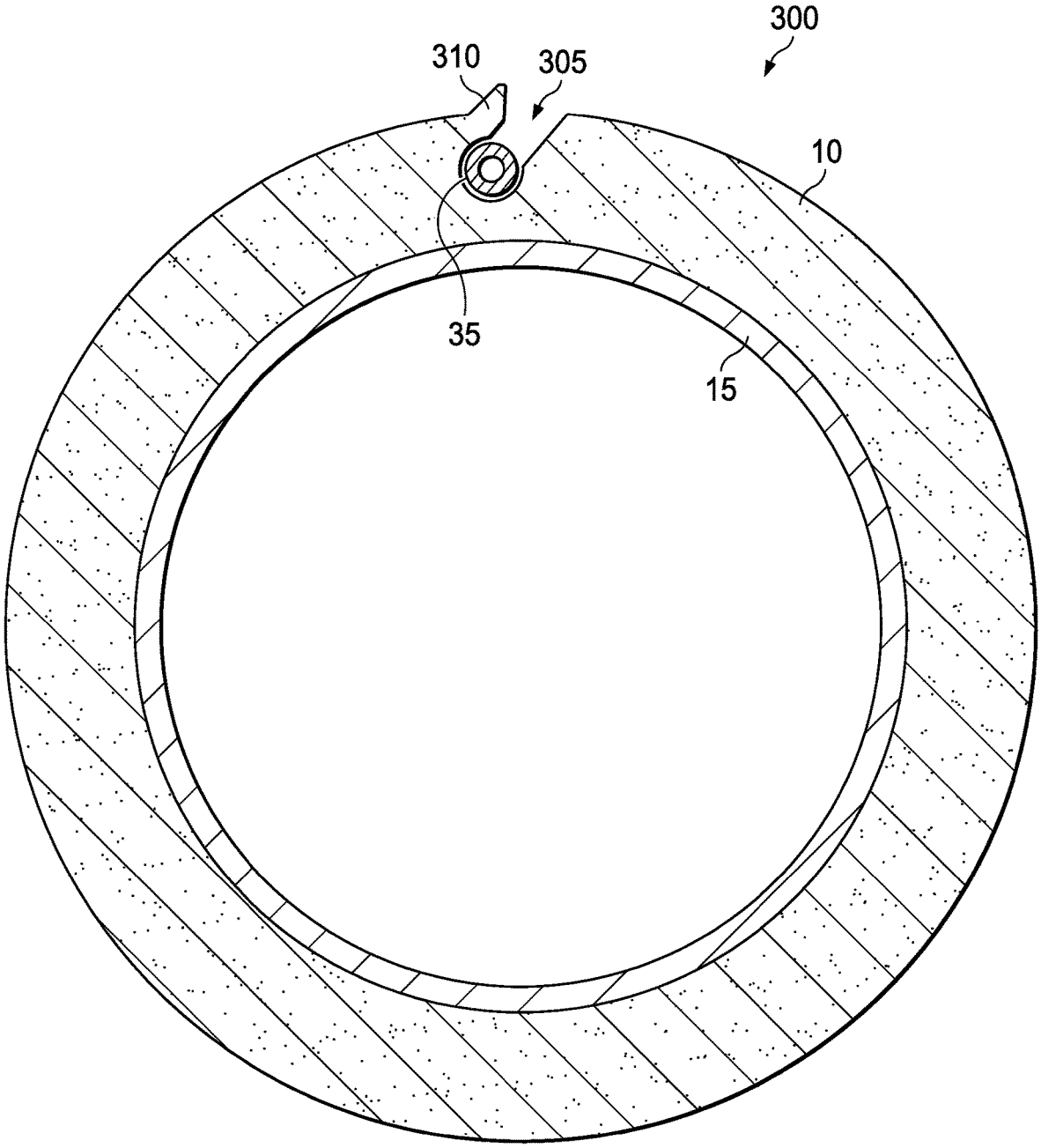
FIG. 7 is a cross-section view of an example wellbore sealing system comprising a closeable flange in accordance with the examples disclosed herein.

FIG. 7 is a cross-section view of another example of a wellbore sealing system, generally 300. The wellbore sealing system 300 is similar to the wellbore sealing systems 5, 100, and 200 illustrated in FIGS. 1-6. The wellbore sealing system 300 comprises an expandable metal sealing element 10, a conduit 15, and one line 35 disposed within a void 305 in the exterior of the expandable metal sealing element 10. In the illustration of FIG. 7, the void 305 has been designed to have a closeable flange 310. When the line 35 is disposed in the void 305, the flange 310 may be closed to lock the line 35 within the void 305. The die used in the extrusion process to produce the expandable metal sealing element 10 may be designed or modified to provide the illustrated shape of the void 305 and the closeable flange 310 as the expandable metal sealing element 10 is extruded. Thus, the flange 310 comprises the same composition as the rest of the expandable metal sealing element 10. After the line 35 is disposed in the void 305, the flange 310 may be closed by any sufficient method including hammering it closed or rolling it closed. The closure of the flange 310 may be performed on the rig floor or at any other point during the wellbore operation. Although FIG. 7 illustrates the use of one line 35, it is to be understood that any number of lines 35, including more than one line 35, may be used with any of the examples disclosed herein.

Figure 8A:
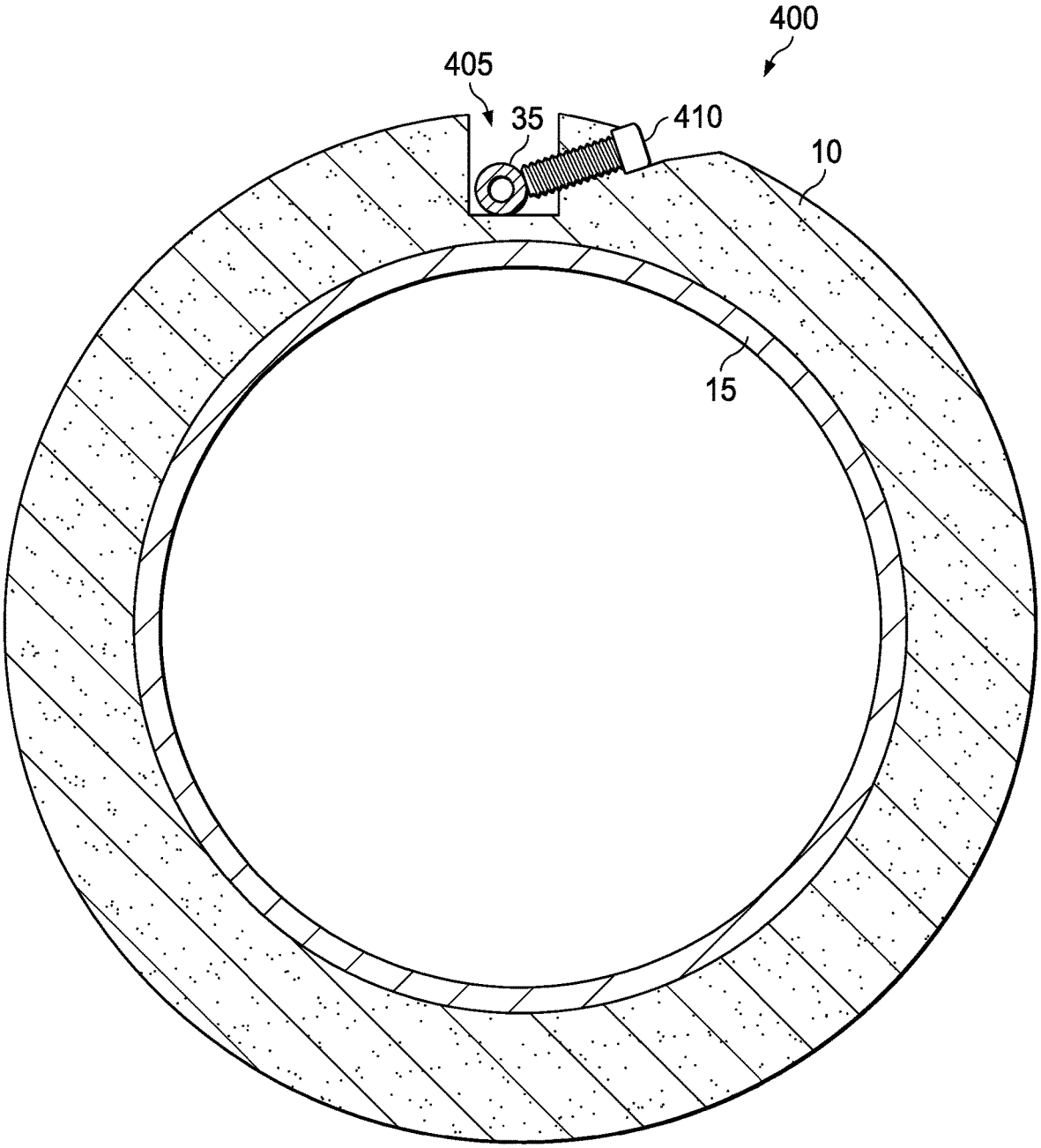
FIG. 8A is a cross-section view of an example wellbore sealing system comprising an expandable metal bolt in accordance with the examples disclosed herein.

FIG. 8A is a cross-section view of another example of a wellbore sealing system, generally 400. The wellbore sealing system 400 is similar to the wellbore sealing systems 5, 100, 200, and 300 illustrated in FIGS. 1-7. The wellbore sealing system 400 comprises an expandable metal sealing element 10, a conduit 15, and one line 35 disposed within a void 405 in the exterior of the expandable metal sealing element 10. In the illustration of FIG. 8A, line 35 is secured win the void 405 with a metal bolt 410. The bolt 410 is inserted into the void 405 through an outer surface of the expandable metal sealing element 10. The bolt 410 has been inserted at an angle to press against the line 35 and pressure it against one of the surfaces defining the void 405. The bolt 410 may be inserted into the expandable metal sealing element 10 on the rig floor or at any other point during the wellbore operation. The bolt 410 may comprise any material sufficient for retaining the line 35 within the void 405. In some examples, the bolt 410 may comprise a reactive metal that is the same or different from the reactive metal selected for the expandable metal sealing element 10. In these examples, the bolt 410 may react with a reaction-inducing fluid to form reaction products and expand volumetrically in an analogous fashion to the expandable metal sealing element 10. In other examples, the bolt 410 is constructed from a non-reactive metal or from a polymer. It is to be understood that although only one bolt 410 is illustrated, any number of bolts may be used as desired. Although FIG. 8A illustrates the use of one line 35, it is to be understood that any number of lines 35, including more than one line 35, may be used with any of the examples disclosed herein. In some examples, the bolt 410 is threadedly connected to the expandable metal sealing element 10 with screw threads. In other examples, the bolt 410 is frictionally connected to the expandable metal sealing element such as with a press fit.

Figure 8B:
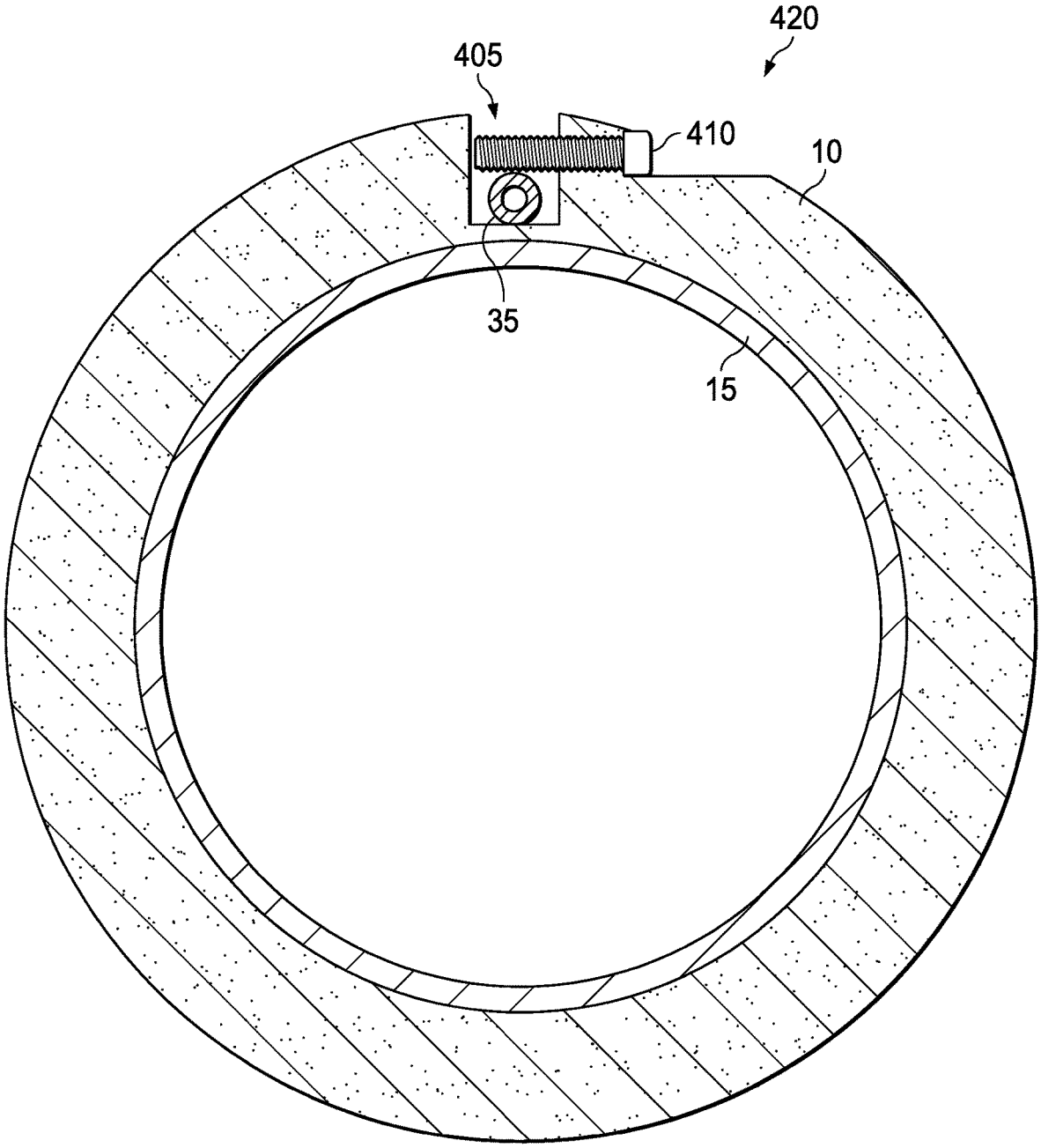
FIG. 8B is a cross-section view of another example wellbore sealing system comprising an expandable metal bolt in accordance with the examples disclosed herein.

FIG. 8B is a cross-section view of another example of a wellbore sealing system, generally 420. The wellbore sealing system 420 is similar to the wellbore sealing system 400 illustrated in FIG. 8A, except that the angle of the bolt 410 has been altered. In the illustration of FIG. 8B, the bolt 410 has been inserted at an angle that traverses the void 405 and traps the line 35 within the void 405 without applying pressure directly against it. The bolt 410 may be inserted into the expandable metal sealing element 10 on the rig floor or at any other point during the wellbore operation. It is to be understood that although only one bolt 410 is illustrated, any number of bolts may be used as desired. Although FIG. 8B illustrates the use of one line 35, it is to be understood that any number of lines 35, including more than one line 35, may be used with any of the examples disclosed herein.

Figure 9A:
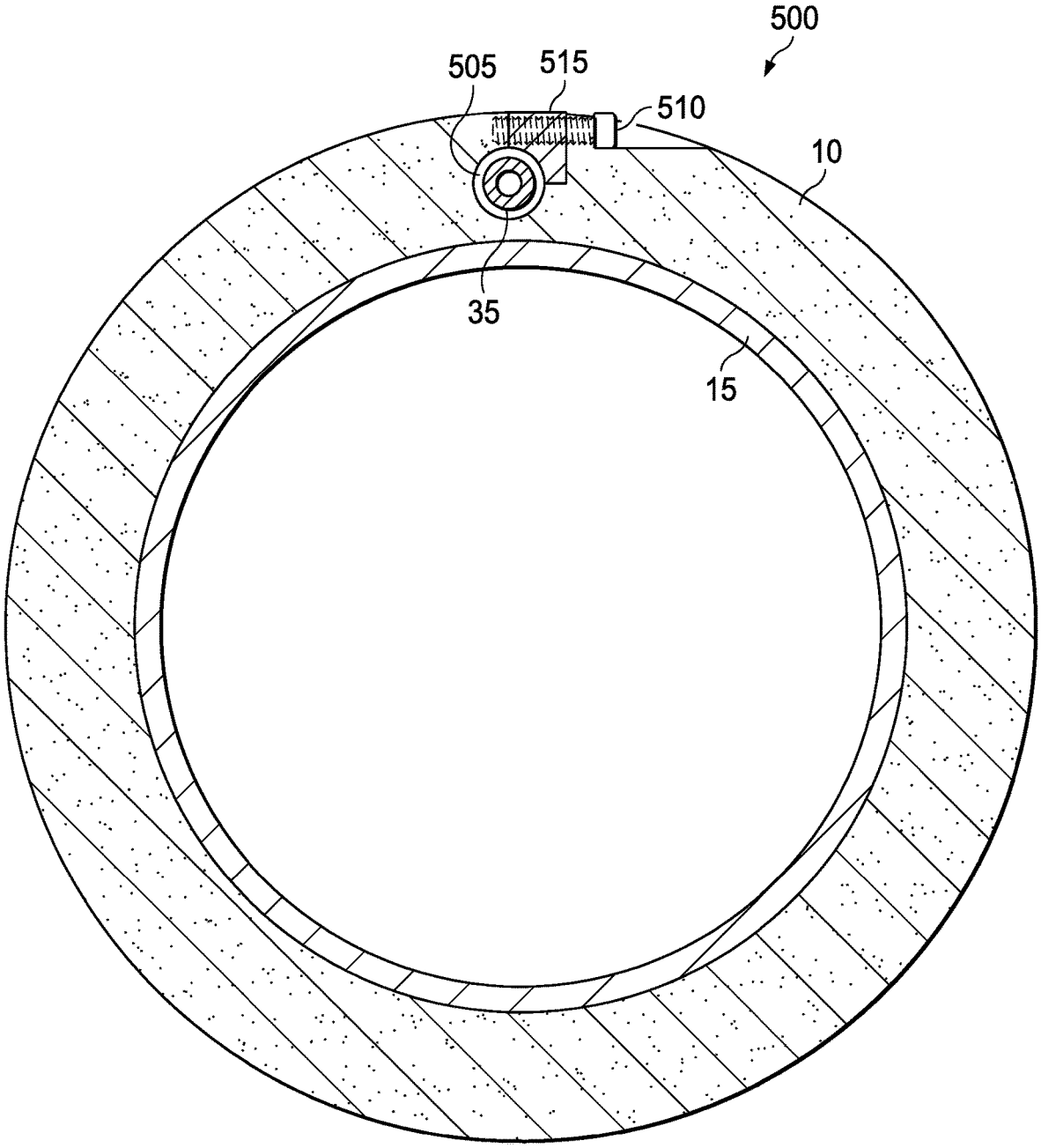
FIG. 9A is a cross-section view of an example wellbore sealing system comprising a piece of reactive metal and a bolt in accordance with the examples disclosed herein.

FIG. 9A is a cross-section view of another example of a wellbore sealing system, generally 500. The wellbore sealing system 500 is similar to the wellbore sealing systems 5, 100, 200, 300, 400, and 420 illustrated in FIGS. 1-8B. The wellbore sealing system 500 comprises an expandable metal sealing element 10, a conduit 15, and one line 35 disposed within a void 505 in the exterior of the expandable metal sealing element 10. In the illustration of FIG. 9A, line 35 is secured with the void 505 by bolting a piece of reactive metal 515 over the opening of the void 505 with a bolt 510. The piece of reactive metal 515 is shaped to fit into the void 505 opening. The bolt 510 is bolted into the piece of reactive metal 515 through an outer surface of the expandable metal sealing element 10 or the piece of reactive metal 515 itself, and the orientation and configuration of bolt 510 may be adjusted as desired. In the illustrated example, the void 505 is shaped similarly to the void 205 illustrated in FIG. 6. The piece of reactive metal 515 may be shaped to fit into the portion of the void 505 that is wider than the portion in which the line 35 may snap into. The bolt 510 may be inserted into the expandable metal sealing element 10 or the piece of reactive metal 515 on the rig floor or at any other point during the wellbore operation. The bolt 510 may comprise any material sufficient for retaining line 35 within the void 505. In some examples, the bolt 510 may comprise a reactive metal that is the same or different from the reactive metal selected for the expandable metal sealing element 10. In these examples, the bolt 510 may react with a reaction-inducing fluid to form reaction products and expand volumetrically in an analogous fashion to the expandable metal sealing element 10. In another example, the bolt 510 may comprise a non-reactive metal or a polymer. It is to be understood that although only one bolt 510 is illustrated, any number of bolts may be used as desired. The piece of reactive metal 515 may comprise a reactive metal that is the same or different from the reactive metal selected for the expandable metal sealing element 10. The piece of reactive metal 515 may react with a reaction-inducing fluid to form reaction products and expand volumetrically in an analogous fashion to the expandable metal sealing element 10. Although FIG. 9A illustrates the use of one line 35, it is to be understood that any number of lines 35, including more than one line 35, may be used with any of the examples disclosed herein. In some optional examples, a clamp may be used instead of or in addition to the bolt 510. In some examples, the bolt 510 is threadedly connected to the expandable metal sealing element 10 with screw threads. In other examples, the bolt 510 is frictionally connected to the expandable metal sealing element such as with a press fit.

Figure 9B:
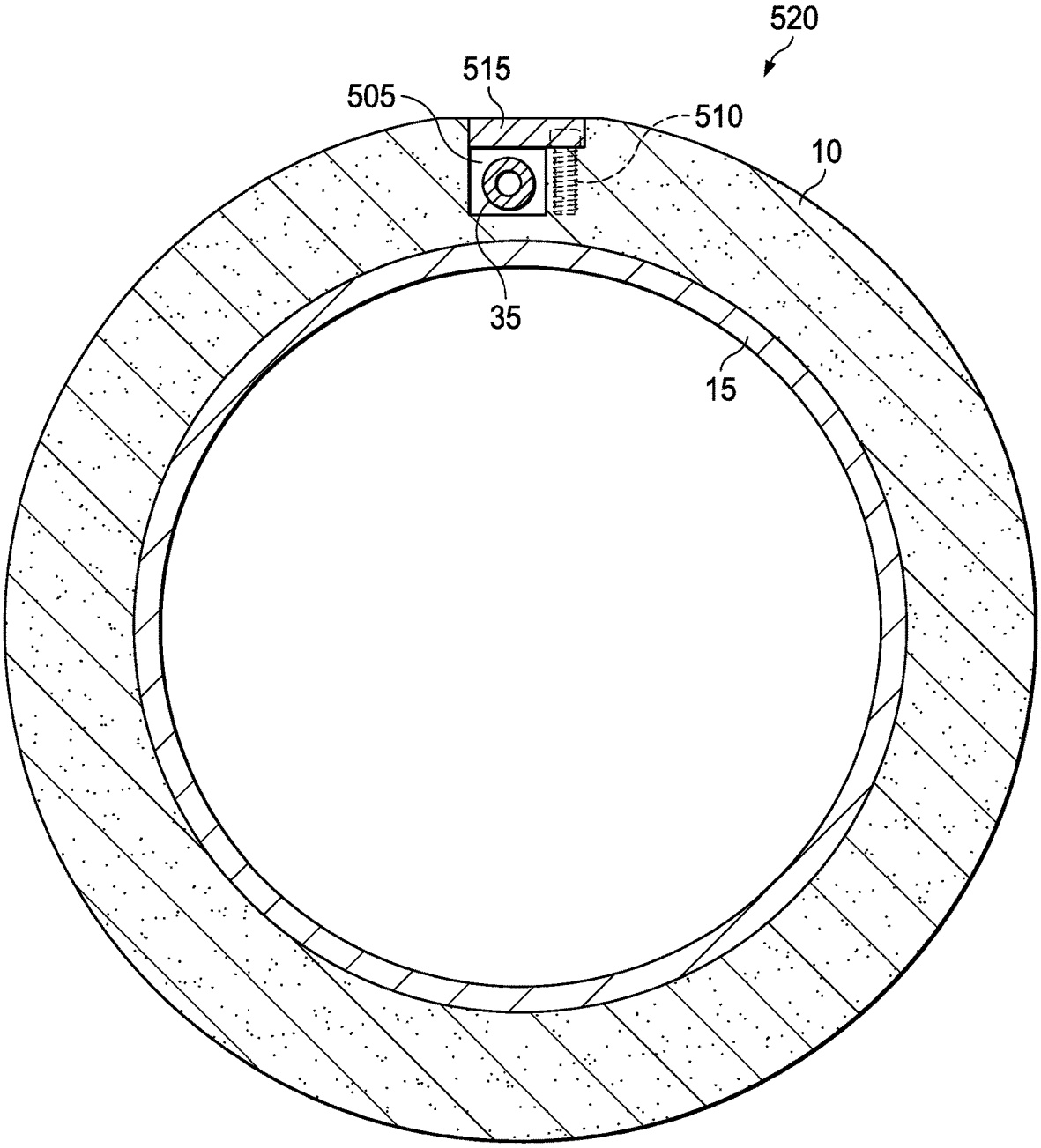
FIG. 9B is a cross-section view of another example wellbore sealing system comprising a piece of reactive metal and a bolt in accordance with the examples disclosed herein.

FIG. 9B is a cross-section view of another example of a wellbore sealing system, generally 520. The wellbore sealing system 520 is similar to the wellbore sealing system 500 illustrated in FIG. 9A, except that the shape of the void 505 is different and the angle of the bolt 510 has been altered. In the illustration of FIG. 9B, the void 505 is similar in shape to the void 405 illustrated in FIGS. 8A and 8B. The bolt 510 is inserted through the piece of reactive metal 515 laid over the void 505 and bolted into the expandable metal sealing element 10. The bolt 510 may be inserted into the expandable metal sealing element 10 on the rig floor or at any other point during the wellbore operation. It is to be understood that although only one bolt 510 is illustrated, any number of bolts 510 may be used as desired. Although FIG. 9B illustrates the use of one line 35, it is to be understood that any number of lines 35, including more than one line 35, may be used with any of the examples disclosed herein. In some optional examples, a clamp may be used instead of or in addition to the bolt 510.

Figure 10:
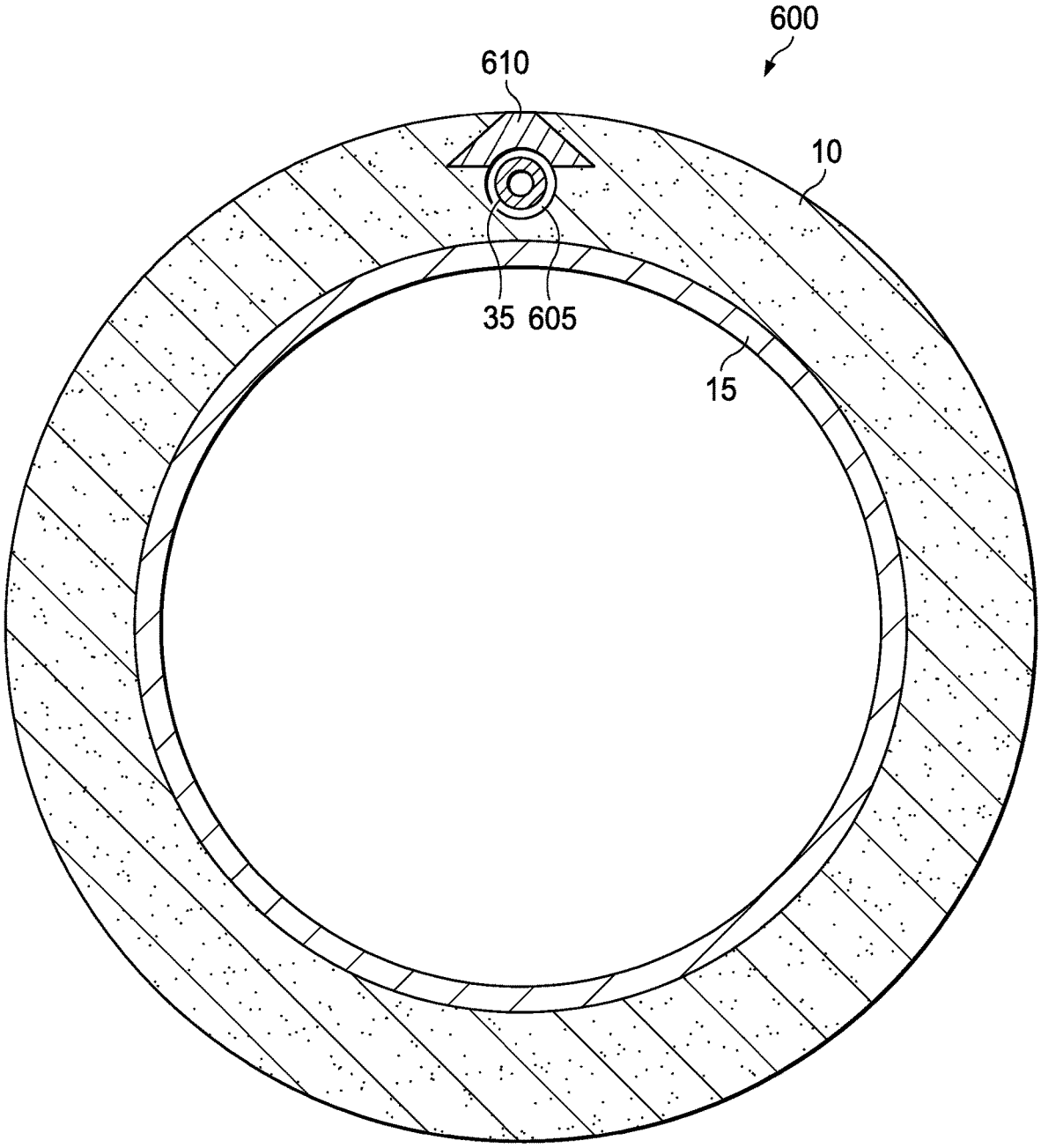
FIG. 10 is a cross-section view of an example wellbore sealing system comprising a dovetail wedge in accordance with the examples disclosed herein.

FIG. 10 is a cross-section view of another example of a wellbore sealing system, generally 600. The wellbore sealing system 600 is similar to the wellbore sealing systems 5, 100, 200, 300, 400, 420, 500, and 520 illustrated in FIGS. 1-9B. The wellbore sealing system 600 comprises an expandable metal sealing element 10, a conduit 15, and one line 35 disposed within a void 605 in the exterior of the expandable metal sealing element 10. In the illustration of FIG. 10, the void 605 has been shaped to have a dovetail configuration. When the line 35 is disposed in the void 605, a wedge 610 may be forced into the void 605 to secure and retain the lines 35 therein. The wedge 610 may comprise any material sufficient for retaining the line 35 within the void 605. In some examples, the wedge 610 may comprise a reactive metal that is the same or different from the reactive metal selected for the expandable metal sealing element 10. In these examples, the wedge 610 may react with a reaction-inducing fluid to form reaction products and expand volumetrically in an analogous fashion to the expandable metal sealing element 10. The die used in the extrusion process to produce the expandable metal sealing element 10 may be designed or modified to provide the illustrated shape of the void 605 as the expandable metal sealing element 10 is extruded. Although a dovetail shape is illustrated, other shapes that allow locking of the wedge 610 may be used as would be readily apparent to one of ordinary skill in the art. The wedge 610 may be shaped to fit snugly within the void 605 and to prevent the escape of the line 35 when the wellbore sealing system 600 is introduced downhole. The insertion of the wedge 610 may be performed on the rig floor or at any other point during the wellbore operation. Although FIG. 10 illustrates the use of one line 35, it is to be understood that any number of lines 35, including more than one line 35, may be used with any of the examples disclosed herein.

Figure 11:
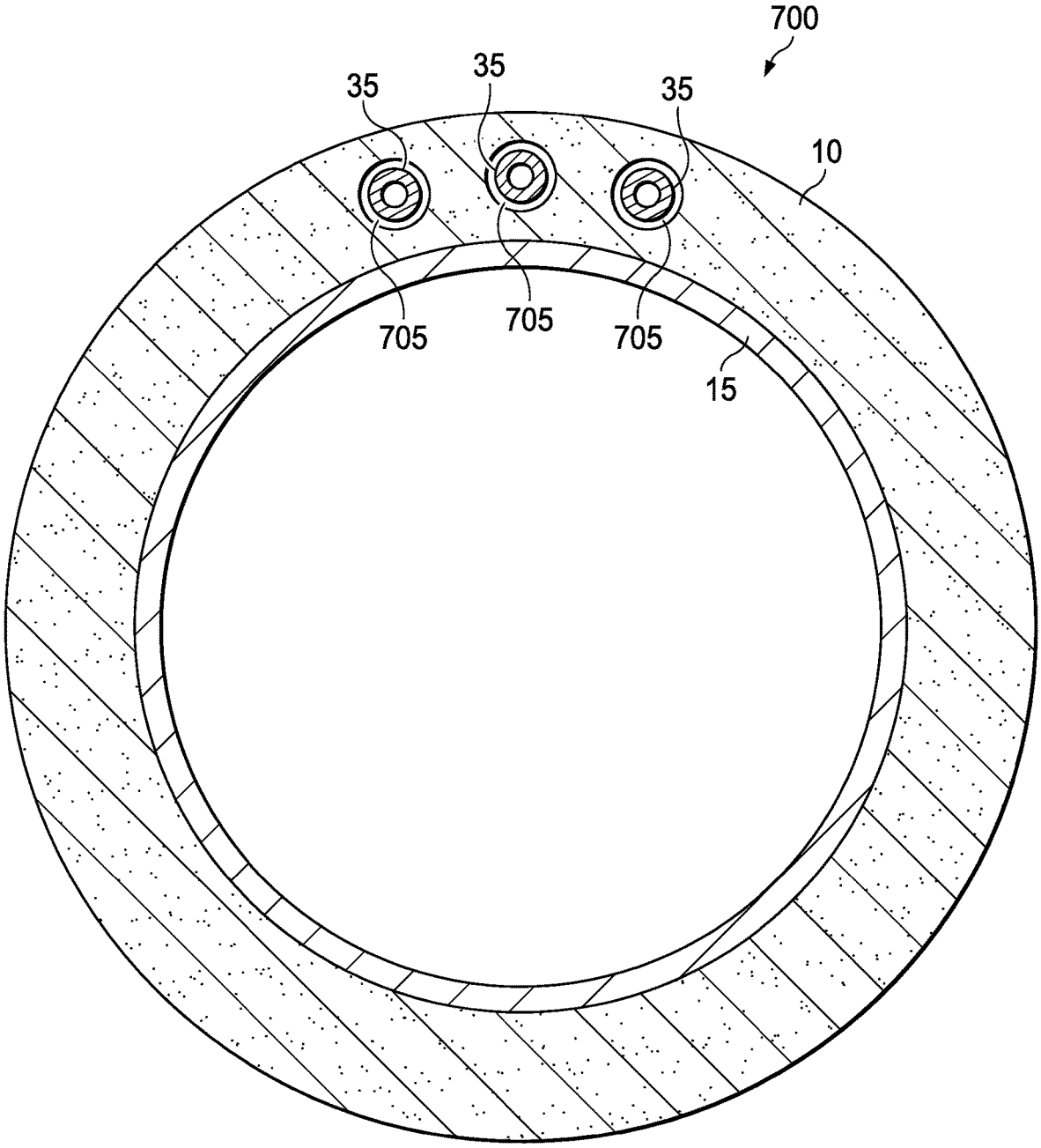
FIG. 11 is a cross-section view of an example wellbore sealing system comprising voids in the body of the expandable metal sealing element in accordance with the examples disclosed herein.

FIG. 11 is a cross-section view of another example of a wellbore sealing system, generally 700. The wellbore sealing system 700 is similar to the wellbore sealing systems 5, 100, 200, 300, 400, 420, 500, 520, and 600 illustrated in FIGS. 1-10. The wellbore sealing system 700 comprises an expandable metal sealing element 10, a conduit 15, and three lines 35 disposed within three voids 705. In the illustration of FIG. 11, the voids 705 are not disposed in the exterior of the expandable metal sealing element 10 but instead are disposed through the body of the expandable metal sealing element 10. The lines 35 may then be directed through the voids 705, or a cable with a connection point may be inserted into the voids 705, and the lines may be connected afterwards. The die used in the extrusion process to produce the expandable metal sealing element 10 may be designed or modified to produce the voids 705 through the body of the expandable metal sealing element 10 as it is extruded. Alternatively, the voids 705 may be drilled into the expandable metal sealing element 10. Although FIG. 11 illustrates the use of three lines 35, it is to be understood that any number of lines 35, including less than or more than three lines 35, may be used with any of the examples disclosed herein.

Figure 12:
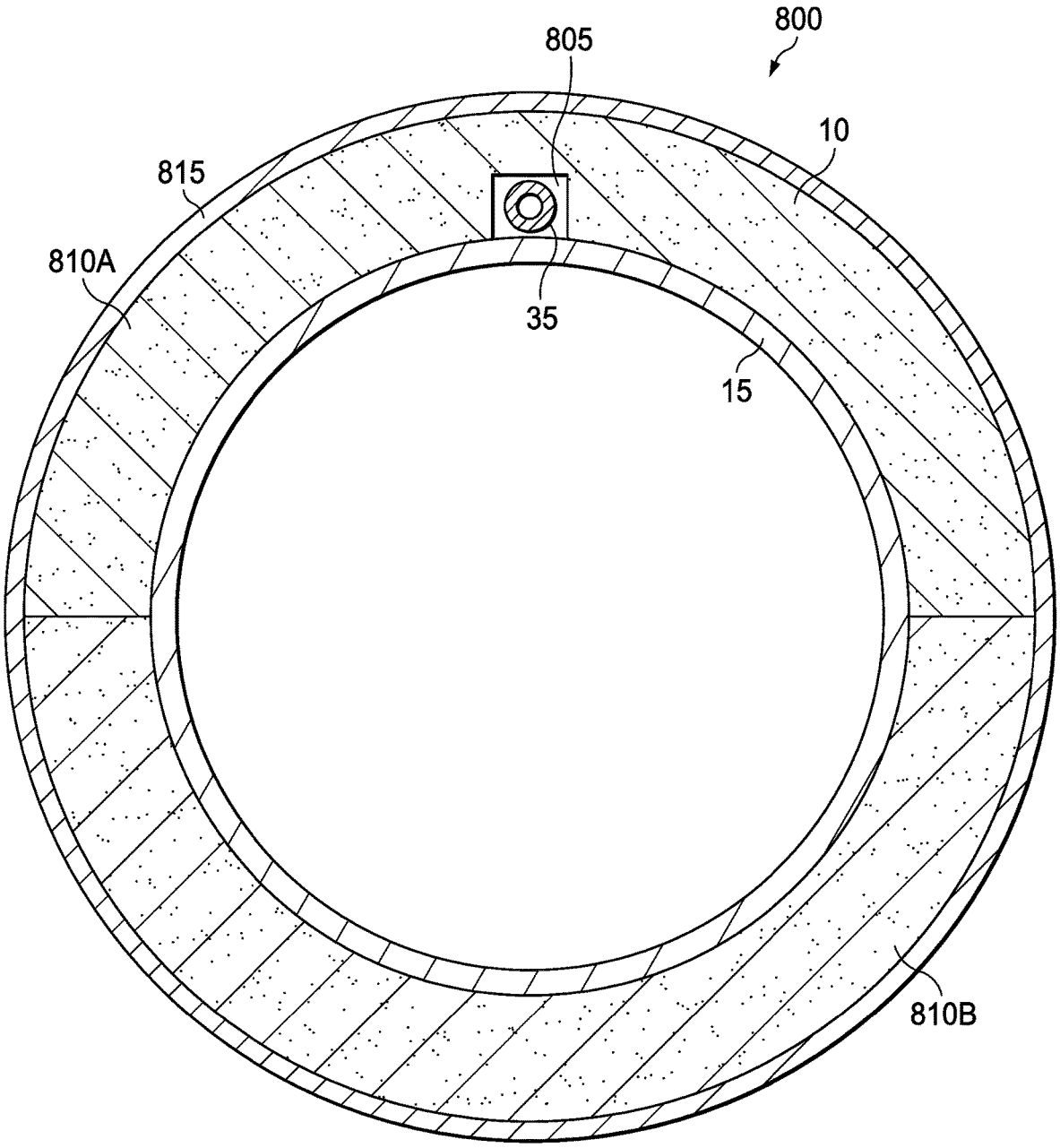
FIG. 12 is a cross-section view of an example wellbore sealing system comprising the void on the interior of the expandable metal sealing element in accordance with the examples disclosed herein.

FIG. 12 is a cross-section view of another example of a wellbore sealing system, generally 800. The wellbore sealing system 800 is similar to the wellbore sealing systems 5, 100, 200, 300, 400, 420, 500, 520, 600, and 700 illustrated in FIGS. 1-11. The wellbore sealing system 800 comprises an expandable metal sealing element 10, a conduit 15, and a line 35 disposed within a void 805. In the illustration of FIG. 12, the void 805 is not disposed in the exterior of the expandable metal sealing element 10 but is instead disposed on the interior of the expandable metal sealing element 10. The line 35 is disposed in this interior void 805. In order to access the void 805, the expandable metal sealing element 10 may comprise two or more pieces, 810A and 810B. The pieces 810A and 810B may be joined together on the rig floor or at any other point in the wellbore operation. When joined, a clamp 815 or other such retaining component may be used to keep the pieces 810A and 810B together. In alternative examples, bolts, hinges, or adhesives may be used instead or in addition to the clamp 815 to keep the pieces 810A and 810B together. The clamp 815 may comprise any material sufficient for retaining the line 35 within the void 805. In some examples, the clamp 815 may comprise a reactive metal that is the same or different from the reactive metal selected for the expandable metal sealing element 10. In these examples, the clamp 815 may react with a reaction-inducing fluid to form reaction products and expand volumetrically in an analogous fashion to the expandable metal sealing element 10. Although FIG. 12 illustrates the use of one line 35, it is to be understood that any number of lines 35, including more than one line 35, may be used with any of the examples disclosed herein. Although FIG. 12 shows the clamp 815 circumscribing the expandable metal sealing element 10, it is to be understood that the clamp 815 may cover a portion of the angle or may circumscribe the element 10 multiple times.

It should be clearly understood that the examples illustrated by FIGS. 1-12 are merely general applications of the principles of this disclosure in practice, and a wide variety of other examples are possible. Therefore, the scope of this disclosure is not limited in any manner to the details of any of the FIGURES described herein.

It is also to be recognized that the systems may also directly or indirectly affect the various downhole equipment and tools that may come into contact with the systems during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in any of the FIGURES.

Provided are methods for traversing an expandable metal sealing element in accordance with the disclosure and the illustrated FIGURES. An example method comprises positioning an expandable metal sealing element in a wellbore; wherein the expandable metal sealing element comprises a reactive metal and a void extending axially through at least a portion of the expandable metal sealing element. The method further comprises disposing a line in the void and contacting the expandable metal sealing element with a fluid that reacts with the reactive metal to produce a reaction product having a volume greater than the reactive metal, wherein the reaction product seals around the line while it is disposed in the void.

Additionally or alternatively, the method may include one or more of the following features individually or in combination. The void may be on the exterior surface of the expandable metal sealing element. The void may be on the interior surface of the expandable metal sealing element. The void may be disposed through a body of the expandable metal sealing element. A clamp may cover the void while the line is disposed in the void. A bolt may traverse the void and prevents the line from being removed from the void. The reactive metal may be a first reactive metal; wherein the bolt comprises a second reactive metal. The expandable metal sealing element may further comprise a closeable flange that closes to cover the void while the line is disposed in the void. An endplate may be coupled to an end of the expandable metal sealing element and the endplate retains the line in the void. A wedge may be inserted into the void after the line is disposed in the void; and wherein the wedge retains the line in the void. The void may comprise an opening that is narrowed.

Provided are expandable metal sealing elements for forming a seal in a wellbore in accordance with the disclosure and the illustrated FIGURES. An example expandable metal sealing element comprises a reactive metal and a void extending axially through at least a portion of the expandable metal sealing element.

Additionally or alternatively, the apparatus may include one or more of the following features individually or in combination. The void may be on the exterior surface of the expandable metal sealing element. The void may be on the interior surface of the expandable metal sealing element. The void may be disposed through a body of the expandable metal sealing element. A clamp may cover the void while a line is disposed in the void. A bolt may traverse the void and prevent a line from being removed from the void. The reactive metal may be a first reactive metal; wherein the bolt comprises a second reactive metal. The expandable metal sealing element may further comprise a closeable flange that closes to cover the void while a line is disposed in the void. An endplate may be coupled to an end of the expandable metal sealing element and the endplate retains a line in the void. A wedge may be inserted into the void after a line is disposed in the void; and wherein the wedge retains the line in the void. The void may comprise an opening that is narrowed.

Provided are systems for forming a seal in a wellbore in accordance with the disclosure and the illustrated FIGURES. An example system comprises an expandable metal sealing element comprising a reactive metal and disposed on a conduit in a location, wherein the reactive metal is reactable with a fluid to produce a reaction product having a volume greater than the reactive metal. The expandable metal sealing element further comprises a void extending axially through at least a portion of the expandable metal sealing element. The system further comprises a line disposed in the void and the conduit.

Additionally or alternatively, the system may include one or more of the following features individually or in combination. The void may be on the exterior surface of the expandable metal sealing element. The void may be on the interior surface of the expandable metal sealing element. The void may be disposed through a body of the expandable metal sealing element. A clamp may cover the void while a line is disposed in the void. A bolt may traverse the void and prevent a line from being removed from the void. The reactive metal may be a first reactive metal; wherein the bolt comprises a second reactive metal. The expandable metal sealing element may further comprise a closeable flange that closes to cover the void while a line is disposed in the void. An endplate may be coupled to an end of the expandable metal sealing element and the endplate retains a line in the void. A wedge may be inserted into the void after a line is disposed in the void; and wherein the wedge retains the line in the void. The void may comprise an opening that is narrowed.

The preceding description provides various examples of the apparatus, systems, and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for traversing an expandable metal sealing element, the method comprising:

positioning an expandable metal sealing element in a wellbore; wherein the expandable metal sealing element comprises a reactive metal and a void extending axially through at least a portion of the expandable metal sealing element; wherein the reactive metal comprises a metal selected from the group consisting of magnesium, calcium, aluminum, tin, zinc, beryllium, barium, manganese, and any combination thereof, disposing a line in the void, securing the line in the void with a bolt threaded into the expandable metal sealing element, and contacting the expandable metal sealing element with a fluid that chemically reacts with the reactive metal to produce a reaction product having a volume greater than the reactive metal, wherein the reaction product is chemically distinct from the reactive metal, wherein the reaction product forms an irreversible seal around the line while it is disposed in the void.

2. The method of claim 1, wherein the void is on the exterior surface of the expandable metal sealing element.

3. The method of claim 1, wherein the void is on the interior surface of the expandable metal sealing element.

4. The method of claim 1, wherein the void is disposed through a body of the expandable metal sealing element.

5. The method of claim 1, wherein a clamp covers the void while the line is disposed in the void.

6. The method of claim 1, wherein the reactive metal is a first reactive metal; wherein the bolt comprises a second reactive metal.

7. The method of claim 1, wherein the expandable metal sealing element further comprises a closeable flange that closes to cover the void while the line is disposed in the void.

8. The method of claim 1, wherein an endplate is coupled to an end of the expandable metal sealing element and the endplate retains the line in the void.

9. The method of claim 1, wherein a wedge is inserted into the void after the line is disposed in the void; and wherein the wedge retains the line in the void.

10. The method of claim 1, wherein the void comprises an opening that is narrowed.

11. An expandable metal sealing element comprising:

a reactive metal comprising a metal selected from the group consisting of magnesium, calcium, aluminum, tin, zinc, beryllium, barium, manganese, and any combination thereof, a void extending axially through at least a portion of the expandable metal sealing element, wherein the void is configured to contain a line disposed in the void, wherein the reactive metal is configured to chemically react with a fluid to produce a reaction product having a volume greater than the reactive metal, wherein the reaction product is chemically distinct from the reactive metal, wherein the reaction product forms an irreversible seal around the line while it is disposed in the void, wherein the expandable metal sealing element is configured to chemically react with the fluid while in a wellbore to form the irreversible seal around the line in the wellbore, and a bolt configured to secure the line in the void and threaded into the expandable metal sealing element.

12. The expandable metal sealing element of claim 11, wherein the void is on the exterior surface of the expandable metal sealing element.

13. The expandable metal sealing element of claim 11, wherein the void is on the interior surface of the expandable metal sealing element.

14. The expandable metal sealing element of claim 11, wherein the void is disposed through a body of the expandable metal sealing element.

15. The expandable metal sealing element of claim 11, wherein the expandable metal sealing element further comprises a closeable flange that closes to cover the void while a line is disposed in the void.

16. The expandable metal sealing element of claim 11, wherein the reactive metal is a first reactive metal; wherein the bolt comprises a second reactive metal.

17. The system of claim 11, wherein the void is disposed through a body of the expandable metal sealing element.

18. A system for forming a seal in a wellbore, the system comprising:

an expandable metal sealing element comprising a reactive metal comprising a metal selected from the group consisting of magnesium, calcium, aluminum, tin, zinc, beryllium, barium, manganese, and any combination thereof; wherein the expandable metal sealing element is disposed on a conduit in a location, wherein the reactive metal is chemically reactable with a fluid to produce a reaction product having a volume greater than the reactive metal, wherein the reaction product is chemically distinct from the reactive metal, wherein the expandable metal sealing element further comprises a void extending axially through at least a portion of the expandable metal sealing element, a line disposed in the void, wherein the reaction product forms an irreversible seal around the line while it is disposed in the void in the wellbore, a bolt securing the line in the void and threaded into the expandable metal sealing element, and the conduit.

19. The system of claim 18, wherein the void is on the exterior surface of the expandable metal sealing element.

20. The system of claim 18, wherein the void is on the interior surface of the expandable metal sealing element.

* * * * *